US006244442B1

(12) United States Patent
Inoue et al.

(10) Patent No.: US 6,244,442 B1
(45) **Date of Patent: *Jun. 12, 2001**

(54) PACKAGE, METHOD OF MANUFACTURING THE PACKAGE AND PACKET OF THE PACKAGE

(75) Inventors: Isao Inoue; Kiyoshi Oguchi; Masaho Hayashi; Atushi Saiki, all of Tokyo-To (JP)

(73) Assignee: Dai Nippon Printing Co., Ltd. (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 97 days.

(21) Appl. No.: 08/809,718

(22) Filed: Mar. 28, 1997

(30) Foreign Application Priority Data

| | | |
|---|---|---|
| Sep. 13, 1995 | (JP) | 7-235755 |
| Dec. 25, 1995 | (JP) | 7-337372 |
| Dec. 25, 1995 | (JP) | 7-337385 |
| Jun. 10, 1996 | (JP) | 8-147659 |
| Jun. 10, 1996 | (JP) | 8-168681 |

(51) Int. Cl.[7] ..... B65D 83/04

(52) U.S. Cl. ..... 206/531; 206/534.1; 206/539; 206/469; 220/643

(58) Field of Search ..... 206/531, 534.1, 206/539, 469, 471, 480, 481, 538, 1.5; 220/642, 643, 654, 648

(56) References Cited

U.S. PATENT DOCUMENTS

| | | | | |
|---|---|---|---|---|
| 3,380,578 | * | 4/1968 | Sparks | 206/532 |
| 3,912,082 | * | 10/1975 | Gerner et al. | 206/531 |
| 4,537,312 | | 8/1985 | Intini . | |
| 4,575,470 | | 3/1986 | Fakirov et al. . | |
| 4,664,262 | * | 5/1987 | White | 206/534 |
| 4,889,236 | * | 12/1989 | Bartell et al. | 206/531 |
| 4,958,736 | * | 9/1990 | Urheim | 206/531 |
| 5,014,851 | * | 5/1991 | Wick | 206/539 |
| 5,591,468 | * | 1/1997 | Stockley, III et al. | 426/106 |
| 5,791,478 | * | 8/1998 | Kalvelage et al. | 206/531 |

FOREIGN PATENT DOCUMENTS

| | | |
|---|---|---|
| 2 144 009 | 3/1973 | (DE) . |
| 28 53 73 A1 | 7/1980 | (DE) . |
| 28 53 737 A1 | 7/1980 | (DE) . |
| 30 28 808 A1 | 3/1982 | (DE) . |
| 86 05 900 U | 7/1986 | (DE) . |
| 0 084 119 A1 | 7/1983 | (EP) . |
| 0 656 389 A1 | 6/1995 | (EP) . |
| 2 216 102 | 10/1989 | (GB) . |
| 2 223 001 | 3/1990 | (GB) . |
| 2 277 920 | 11/1994 | (GB) . |
| 47-46298 | 12/1972 | (JP) . |
| 56-131374 | 10/1981 | (JP) . |
| 56-175366 | 12/1981 | (JP) . |
| 59-109664 | 7/1984 | (JP) . |
| 61-258750 | 11/1986 | (JP) . |
| 64-51065 | 3/1989 | (JP) . |
| 3-14403 | 1/1991 | (JP) . |
| 3-275464 | 12/1991 | (JP) . |
| 4-38901 | 4/1992 | (JP) . |
| 5-54350 | 7/1993 | (JP) . |
| 6-48421 | 2/1994 | (JP) . |
| 7-41042 | 2/1995 | (JP) . |
| 7-149367 | 6/1995 | (JP) . |
| WO 91/07332 | 5/1991 | (WO) . |
| WO 95/17304 | 6/1995 | (WO) . |

* cited by examiner

*Primary Examiner*—Paul T. Sewell
*Assistant Examiner*—Shian Luong
(74) *Attorney, Agent, or Firm*—Parkhurst & Wendel, L.L.P.

(57) ABSTRACT

A package (10) has blisters (11) each having an embossed hollow (12) with an open end, for containing a tablet (15), and a flange (13) extending around the open end of the embossed hollow (12). The flanges (13) of the blisters (11) are bonded to a covering sheet 20. The blisters (11) are formed separately, and the flange (13) of each blister (11) has a circular shape.

30 Claims, 16 Drawing Sheets

PACKAGE, METHOD OF MANUFACTURING THE PACKAGE AND PACKET OF THE PACKAGE

TECHNICAL FIELD

The present invention relates to a package containing articles, such as tablets, and capable of being safely used, a method of manufacturing the package, and a packet of the package.

BACKGROUND ART

A conventional tablet package has a base sheet provided with a plurality of blisters and flanges extending around the blisters, and contains tablets in the blisters. Tablets are put in the blisters and the blisters are sealed by attaching a covering sheet by heat-sealing to the flanges of the base sheet.

Tablets are put in the blisters formed in the base sheet, and then the covering sheet is bonded to the flanges of the blisters formed in the base sheet by heat-sealing to obtain a package (PTP package). The base sheet and the covering sheet of the package are perforated to divide the package into a plurality of unit blister packages each having the blister containing the tablet and covered with a section of the covering sheet. The package can be torn along the perforations to separate each unit blister package from the package.

The base sheet is made of polyvinyl chloride (PVC) or the like and is relatively thick to hold the tablets securely, and the covering sheet is relatively thin as compared with the base sheet.

The unit blister package is separated from the package by tearing the base sheet and the covering sheet along the perforations, and then the section of the covering sheet is torn off to take out the tablet from the blister.

Incidentally, it sometimes occurs that a user swallows the unit blister package containing the tablet without taking out the tablet from the blister. If the unit blister package is swallowed, the edges of the flange made of the relatively thick base sheet may possibly injure the internal organs of the user and bring about very dangerous circumstances.

DISCLOSURE OF THE INVENTION

The present invention has been made in view of such a problem and it is therefore an object of the present invention to provide a package having unit blister packages which will not injure the internal organs even if the same is swallowed by mistake, a method of manufacturing the package, and a packet of the package.

According to a first aspect of the present invention, a package comprises a plurality of blisters each having an embossed hollow with an open end, for containing an article, and a flange extending around the open end, and a covering sheet bonded to the flanges. The blisters are separate from each other, and the flanges of the separate blisters are bonded to the covering sheet.

According to a second aspect of the present invention, a package capable of being rolled comprises a soft blister having a plurality of embossed hollows with open ends, for containing an article, and flanges extending around the open upper ends, and a soft covering sheet bonded to the flanges of the soft blister. Rings each having an opening corresponding to the open end of the blister are mounted on the soft blisters or the soft covering sheet.

According to a third aspect of the present invention, a package capable of being rolled comprises a soft blister having a plurality of embossed hollows with open ends, for containing articles and flanges extending around the open end, and a soft covering sheet bonded to the flanges of the soft blister. A reinforcing paper sheet having through holes corresponding to the open ends of the blister is attached to the soft blister or the soft covering sheet.

According to a fourth aspect of the present invention, a package capable of being wound in a roll comprises a plurality of soft blisters each having an embossed hollow with an open end, for containing an article, and a flange extending around the open end of the embossed hollow, and a soft covering sheet bonded to the flanges of the soft blisters. A ring having an opening corresponding to the open end of the embossed hollow is mounted to the soft blisters or the soft covering sheet.

According to a fifth aspect of the present invention, a package manufacturing method comprises the steps of embossing a blister forming sheet between a male die and a female die to form an embossed sheet having a plurality of embossed hollows, cutting the embossed sheet held on a lower die having cavities for receiving the embossed hollows to form blisters each having the embossed hollow and a flange extending around the embossed hollow, and winding up a scrap produced by cutting out the blisters from the embossed sheet, placing articles into the embossed hollows of the blisters held on the lower die respectively, and bonding a covering sheet to the flanges of the blisters held on the lower die.

According to a sixth aspect of the present invention, a packet comprises, a package capable of being wound in a roll comprising a plurality of soft blisters each having an embossed hollow with an open end, for containing an article, and a flange extending around the open end of the embossed hollow, a soft covering sheet bonded to the flanges of the blisters, and a ring having an opening corresponding to the open end of the blister and mounted on the soft blisters or the soft covering sheet; and a container containing the rolled package.

The present invention provides a safe package from which packaged articles can easily be taken out, a method of manufacturing the package, and a packet of the package.

BEST MODE FOR CARRYING OUT THE INVENTION

FIRST EMBODIMENT

Figure 1:
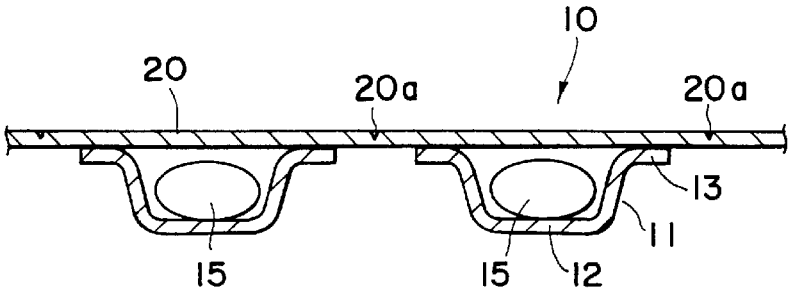
FIG. 1 is a sectional side view of a package in a first embodiment according to the present invention.
Figure 2:
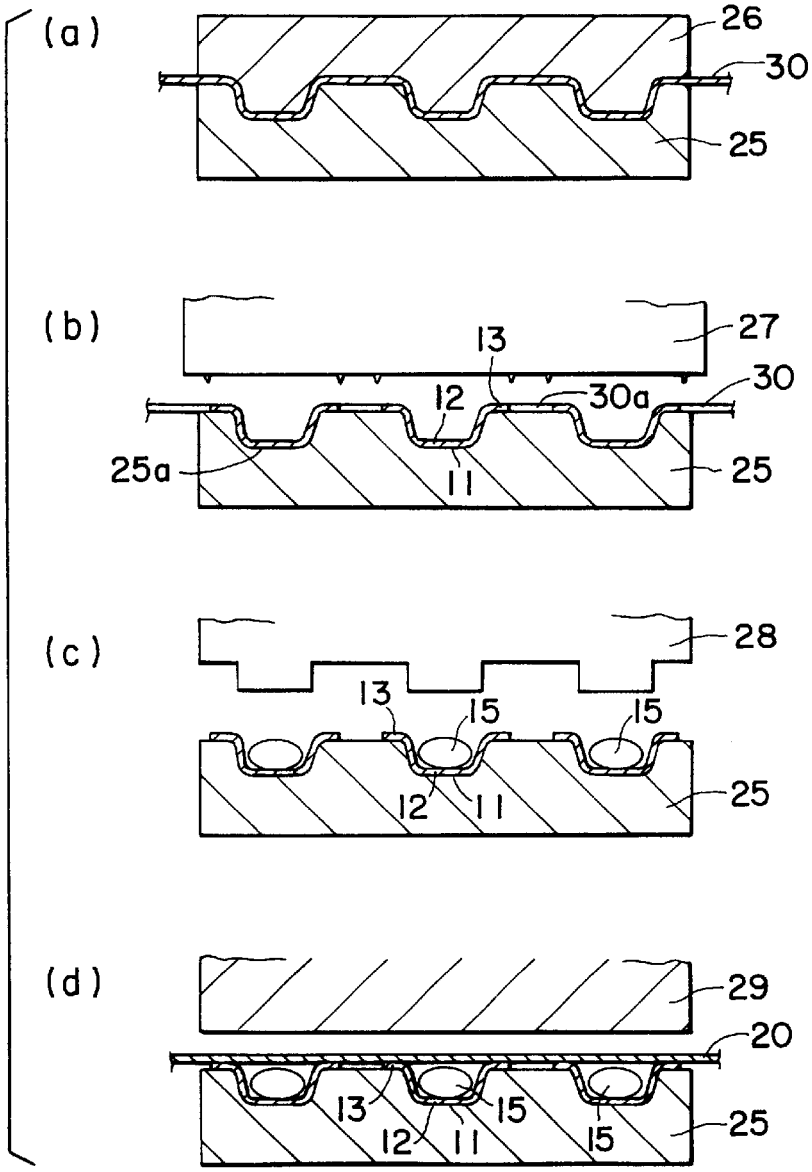
FIG. 2 is a schematic sectional view of assistance in explaining a method of manufacturing the package in the first embodiment.
Figure 3:
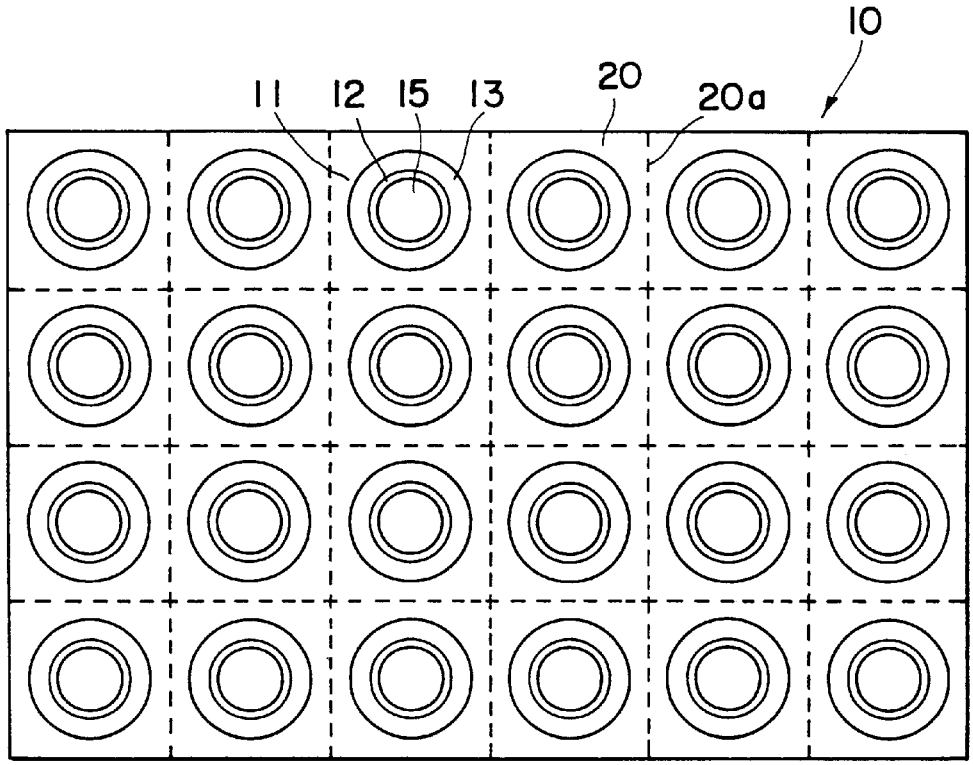
FIG. 3 is a plan view of a package, in which a covering sheet is supposed to be transparent for convenience.

A first embodiment of the present invention will be described hereinafter with reference to the accompanying drawings. FIGS. 1 to 3 illustrates the first embodiment of the present invention.

Referring to FIGS. 1 to 3, a package 10 has a plurality of blisters 11 each having an embossed hollow 12 with an open end, containing an article, such as a tablet 15, and a flange 13 extending around the open end of the embossed hollow 12.

The blisters 11 are formed separately and define the embossed hollows 12 containing the tablets 15, respectively. The flange 13 of the blister 11 is bonded to a covering sheet 20 by heat-sealing.

As shown in FIG. 3, the flanges 13 of the blisters 11 have a circular shape, and the embossed hollows 12 containing the tablets 15 have a circular shape accordingly. The circumference of the flanges 13 may have an elliptic shape instead of the circular shape or may have a polygonal shape having rounded corners.

Thus, the circumference of the flange 13 is formed by straight lines, curves or a combination of straight lines and curves in a safe shape which will not injure the internal organs even if the blister 11 containing the tablet 15 is swallowed.

The covering sheet 20 is provided with tearing incisions 20*a* along which the covering sheet 20 is torn into sections to separate the blisters 11 from the package. The covering sheet 20 may be provided with perforations instead of the tearing incisions.

FIG. 3 is a plan view of the package 10, in which the covering sheet 20 is supposed to be transparent for convenience.

The materials of the components of the package 10 will be explained hereinafter. The blisters 11 of the package 10 are formed by embossing a relatively thick sheet suitable for containing the tablets 15. The blisters 11 may be formed by embossing a 200 to 350 $\mu$m thick sheet of PVC, cyclic polyolefine, PP or PET.

The covering sheet 20 is a relatively thin sheet, such as a 10 to 25 $\mu$m thick laminated sheet consisting of OP layer, an aluminum layer and a heat-sealing layer.

The heat-sealing layer may be made of a thermoplastic resin, such as a vinyl acetate resin, a PVA resin, a polyvinyl butyral resin, a polyvinyl chloride resin, a polyamide resin, a polyester resin, a polyolefine resin, a polyacrylic resin, a cellulose ester resin or a polyethylene resin, a copolymer of some of those resins or a mixture of some of those resins.

A method of manufacturing the package will be described with reference to FIGS. 2(*a*)–(*d*). Referring to FIGS. 2(*a*)–(*d*), a sheet, for example, a PVC sheet, is placed between a female die (lower die) 25 and a male die (upper die) 26, and then the PVC sheet is subjected to pressure forming (embossing) between the female die 25 and the male die 26 to obtain an embossed sheet 30 provided with the plurality of embossed hollows 12 (FIG. 2(*a*)).

The female die 25 holding the embossed sheet 30 is transported to a cutting machine 27, and the cutting machine 27 cuts the embossed sheet 30 along lines around the embossed hollows 12 to form the blisters 11 each having the embossed hollow 12 and the flange 13. The embossed hollows 12 of the blisters 11 are received in cavities 25*a* of the female die 25, respectively, and a scrap 30*a* produced by cutting the embossed sheet 30 is taken up by a winding machine, not shown (FIG. 2(*b*)).

The female die 25 holding the blisters 11 is transported to a tablet dispensing machine 28, and then the tablet dispensing machine puts the tablets 15 in the embossed hollows 12 of the blisters 11 held on the female die 25.

Then, the female die 25 holding the blisters 11 is transported to a heat-sealing machine 29, and then the heat-sealing machine 29 bonds a covering sheet 20 consisting of, for example, an OP layer, an aluminum layer and a heat-sealing layer to the flanges 13 of the blisters 11 by heat-sealing to seal the embossed hollows 12 of the blisters 11. Then, the tearing incisions 20*a* are formed in the covering sheet 20 to complete the package 10 shown in FIGS. 1 and 3.

When using the tablet 15, the covering sheet 20 is torn along the tearing incisions 20*a* to separate the blister 11 from the package 10. Then, the embossed hollow 12 of the blister 11 is pressed, so that a section of the covering sheet 20 covering the embossed hollow 12 is broken and the tablet 15 is taken out from the embossed hollow 12 of the blister 11.

It is possible that the tablet 15 is not taken out from the embossed hollow 12 of the blister 11, and the blister 11 containing the tablet 15 and the section of the covering sheet 20 covering the embossed hollow 12 are swallowed by mistake. In this case, however, since the blister 11 made of a relatively hard, thick material is separated from each other, and the covering sheet 20 is bonded to the flange 13 of the blister 11, the circumferential edge of the flange 13 is not exposed. Furthermore, since the circumferential edge of the flange 13 has a circular shape, the flange 13 will not injure the internal organs even if the circumferential edge of the flange 13 is exposed.

Although the section of the covering sheet 20 covering the embossed hollow 12 has a rectangular shape, the same section of the covering sheet 20 will not injure the fingers or the like because the covering sheet 20 is soft and thin.

In this embodiment, the female die 25 holding the embossed sheet 30 having the blisters 11 is transported from a position corresponding to the male die 26 through the cutting machine 27 and the tablet dispensing machine 28 to the heat-sealing machine 29. The embossed sheet 30 having the blisters 11 may be held on a lower die other than the female die 25, and the lower die may be transported from a position corresponding to the male die 26 through the cutting machine 27 and the tablet dispensing machine 28 to the heat-sealing machine 29.

Thus, according to the present invention, the blisters are formed individually and separately, and the flanges of the blisters are bonded to the covering sheet. Therefore, the circumferential edge of the flange is not exposed when the blister is separated from the package by tearing the covering sheet. Accordingly, the fingers will not be injured by the circumferential edge of the flange of the hard blister when handling the package, and the internal organs will not be injured by the circumferential edge of the flange even if the unit blister package consisting of the blister, the tablet and a section of the covering sheet is swallowed.

SECOND EMBODIMENT

A second embodiment will be described with reference to FIGS. 4 and 5, in which parts like or corresponding to those of the first embodiment shown in FIGS. 1 to 3 are designated by the same reference characters and the description thereof will be omitted. A package 10 in the second embodiment is substantially the same in construction as the package 10 in the first embodiment shown in FIGS. 1 to 3, except that the package 10 in the second embodiment is provided with a covering sheet 20 which is different from that of the first embodiment.

The package 10 has a plurality of blisters 11 each having an embossed hollow 12 with an open end, for containing an article, such as a tablets 15, and a flange 13 (FIGS. 1 to 3).

The blisters 11 having the embossed hollows 12 containing the tablets 15, respectively, are formed separately, and the flanges 13 of the blisters 11 are bonded to the covering sheet 20 by heat-sealing.

As shown in FIG. 3, the flanges 13 of the blisters 11 have a circular shape, and the embossed hollows 12 containing the tablets 15 have a circular shape accordingly. The circumference of the flanges 13 may have an elliptic shape instead of the circular shape or may have a polygonal shape having rounded corners.

Thus, the circumference of the flange 13 is formed by straight lines, curves or a combination of straight lines and curves in a safe shape which will not injure the internal organs even if the blister 11 containing the tablet 15 is swallowed.

The covering sheet 20 is provided with tearing incisions 20*a* along which the covering sheet 20 is torn to separate the blister 11 from the package. The covering sheet 20 may be provided with perforations instead of the tearing incisions. FIG. 3 is a plan view of the package 10, in which the covering sheet 20 is supposed to be transparent for convenience.

The materials of the components of the package 10 will be explained hereinafter. The blisters 11 of the package 10 are formed by embossing a relatively thick sheet suitable for containing the tablets 15. The blisters 11 may be formed by embossing a 200 to 350 $\mu$m thick sheet of PVC, cyclic polyolefine, PP or PET.

The covering sheet 20 is a relatively thin sheet of a thickness in the range of 15 to 25 $\mu$m. Possible materials for forming the covering sheet 20 are described in the following items (1) to (5).

(1) Composite material of a polyolefine resin and an inorganic filler

The covering sheet 20 is made of a composite material containing a PP resin and an inorganic filler, with the content of the inorganic filler being in the range of 30 to 60% by weight.

The PP resin may be a homopolymer, a copolymer (block, random) or a mixture of a homopolymer and a copolymer. Preferably, the PP resin has a melt index (MI) of 20 g per 10 min (JIS K6758) or below. If the covering sheet 20 and the blisters 11 are made of the same PP resin, it is convenient to recycle the covering sheet 20 and the blisters 11, and problems attributable to curling can be solved.

If the covering sheet 20 is made of only a PP resin, a problem arises in the press-through property of the covering sheet 20. The inorganic filler improves the press-through property of the covering sheet 20. The press-through property of the covering sheet 20 is unsatisfactory if the inorganic filler content of the covering sheet 20 is 30% by weight or below, and the covering sheet 20 is excessively tearable if the inorganic filler content is 60% by weight or above.

The covering sheet 20 made of a composite material containing a PP resin and an inorganic filler, with the content of the inorganic filler being in the range of 30 to 60% by weight has a moderate strength and is properly tearable.

The inorganic filler may be, for example, calcium carbonate, talc, alumina, titanium oxide, diatomaceous earth, clay, kaolin or a mixture of some of those inorganic fillers. The mean particle size of the inorganic filler is, for example, in the range of 0.1 to 50 $\mu$m. When necessary, the covering sheet 20 may contain, in addition to a PP resin and an inorganic filler, a coloring matter, an antistatic agent and such.

The covering sheet 20 made of a composite material of a PP resin and an inorganic filler may be provided with a heat-sealing layer and a printed layer. The composite material of a PP resin and an inorganic filler is processed to form a 30 to 100 $\mu$m thick film by a T-die method, an inflation method or the like.

(2) Oriented film containing polyethylene-2,6 naphthalate as a principal component The covering sheet 20 may be a 5 to 150 $\mu$m thick oriented polyethylene-2,6 naphthalate film containing a polyethylene-2,6 naphthalate resin as a principal component and having a limiting viscosity number $\eta$ in the range of 0.3 to 0.53 and a draw ratio in the range of 3 to 6.

The covering sheet 20 may be a laminated film of an oriented polyethylene-2,6 naphthalate film, a steam barrier film and/or an oxygen barrier film.

The covering sheet 20 may be provided with a protective layer of an olefine resin film, a heat-sealing layer or an adhesive layer.

The covering sheet 20 may be provided with a printed layer of a printing ink.

The 5 to 150 μm thick oriented polyethylene-2,6 naphthalate film is produced by preparing a polyethylene-2,6 naphthalate resin having a limiting viscosity number η in the range of 0.3 to 0.53, drawing a film of the polyethylene-2,6 naphthalate resin at a draw ratio in the range of 3 to 6 by a drawing process, and heat-setting the drawn polyethylene-2,6 naphthalate resin film at a temperature in the range of 170 to 260° C. for a time in the range of 1 sec to 30 min by a heat-setting process.

In the drawing process, the resin film is drawing at draw ratios in the range of 3 to 6 and in the range of 1 to 1.8 in substantially perpendicular directions, respectively, at a temperature in the range of 120 to 170° C.

The 5 to 150 μm thick oriented polyethylene-2,6 naphthalate film may be produced by drawing and heat-setting a composite film consisting of a polyethylene-2,6 naphthalate resin film and an olefine resin film produced by the coextrusion of a polyethylene-2,6 naphthalate resin having a limiting viscosity number η in the range of 0.3 to 0.53 and an olefine resin by the foregoing drawing process and heat-setting process, and then removing the olefine resin film from the composite film.

The covering sheet 20 containing the oriented polyethylene-2,6 naphthalate as a principal component is easily tearable in a specific direction.

(3) Uniaxial oriented polypropylene film irradiated with ionizing radiation

The covering sheet 20 is produced by irradiating a uniaxial oriented polypropylene film with ionizing radiation, such as γ rays radiated by cobalt or electron beams in an absorbed dose in the range of 10 to 100 kGy. The uniaxial oriented polypropylene film may be drawn along either the longitudinal axis or the lateral axis. The uniaxial propylene film serving as the covering sheet 20 may be provided with a heat-sealing layer and a printed layer.

The covering sheet 20 produced by irradiating a uniaxial propylene film with γ rays radiated by cobalt or electron beams can easily be torn in the drawing direction.

(4) Film with cut layers

Figure 4:
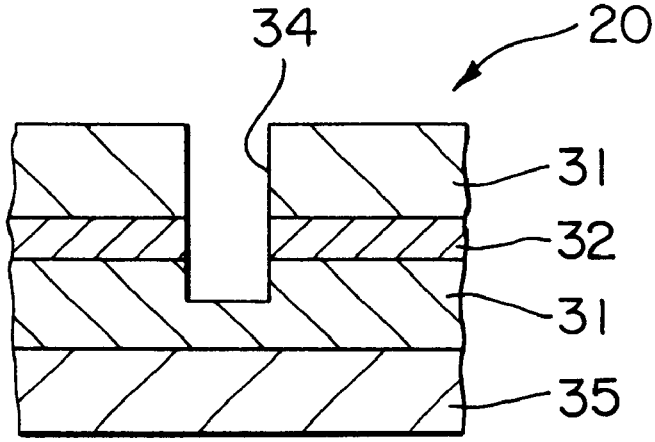
FIG. 4 is a sectional side view of a covering sheet having a cutting layer provided with cutting grooves, to be employed in a package in a second embodiment according to the present invention.
Figure 5:
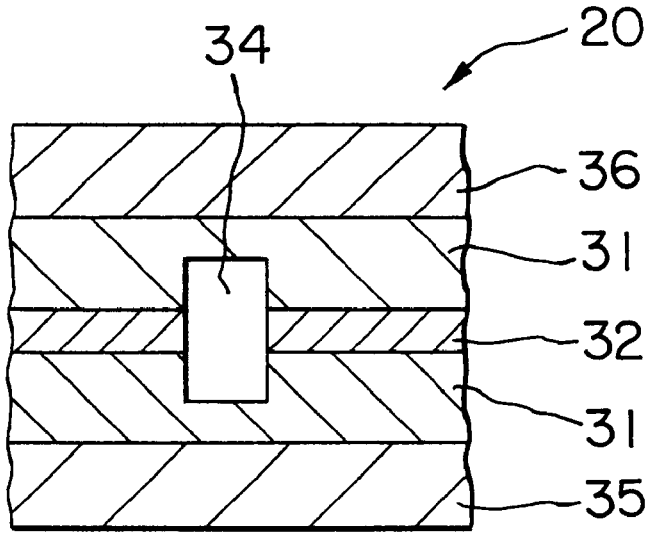
FIG. 5 is a sectional side view of a covering sheet having a cutting layer provided with cutting grooves, to be employed in the package in the second embodiment.

FIGS. 4 and 5 are sectional views of covering sheets 20 provided with cut layers. As shown in FIG. 4, the covering sheet 20 is a multilayer sheet consisting of transparent polymeric film 31, an ink layer 32, a transparent polymeric film 31 and a layer 35 not processed with a laser beam. When the multilayer sheet is irradiated with a laser beam of a wavelength in the range of 0.4 to 1.2 μm, the transparent polymeric film 31 transmits the laser beam and the ink layer 32 generates heat. Portions of the transparent polymeric films 31 on the opposite sides of the ink layer 32 are melted and cutting grooves 34 are formed. In the multilayer sheet shown in FIG. 4, the transparent polymeric films 31 and the ink layer 32 in which the cutting groove 34 is formed are cut layers.

Since the covering sheet 20 is provided with the cutting grooves 34 formed in the transparent polymeric films 31 and the ink layer 32, the covering sheet 20 can easily be cut along the cutting grooves 34. The cutting grooves 34 formed in the transparent polymeric films 31 and the ink layer 32 may be formed in a pattern of straight lines, curved lines, circles or crossing lines.

FIG. 5 shows another example of a multilayer sheet suitable for use as the covering sheet 20. As shown in FIG. 5, the covering sheet 20 is a multilayer sheet of a laser beam transmitting layer 36 which transmits a laser beam and is not processed by the laser beam, a transparent polymeric film 31, an ink layer 32, a transparent polymeric layer 31 and a layer 35 which is not processed by the laser beam. The laser beam transmitting layer 36 transmits a laser beam and is not processed by the laser beam. When the covering sheet 20 is irradiated with a laser beam of a wavelength in the range of 0.4 to 1.2 μm from the side of the laser beam transmitting layer 36 which transmits the laser beam and is not processed by the laser beam, the laser beam travels through the laser beam transmitting layer 36 which is not processed by the laser beam and the transparent polymeric film 31 and generates heat in the ink layer 32. Portions of the transparent polymeric films 31 on the opposite sides of the ink layer 32 are melted by the heat generated in the ink layer 32 and cutting grooves 34 are formed. In the multilayer film shown in FIG. 4, the transparent polymeric films 31 and the ink layer 32 in which the cutting grooves 34 are formed are cut layers.

The ink layers 32 of the covering sheets 20 shown in FIGS. 4 and 5 which absorb a visible near infrared laser beam of a wavelength in the range of 0.4 to 1.2 μm and generate heat may be formed of a pigment, a dye or a polymer which absorbs such a laser beam. Although there is no particular restriction on the material of the ink layers 32, a printing ink is a desirable material of the ink layers 32. Generally, the ink layer 32 of the covering sheet 20 is formed by printing on the back surface of the transparent polymeric film 31. When the covering sheet 20 is provided with the ink layer 32 which absorbs a visible near infrared laser beam of a wavelength in the range of 0.4 to 1.2 μm, the covering sheet 20 need not be provided with any special absorptive layer and hence can be formed in a simple structure. The type of the printing ink may selectively be determined taking into consideration the wavelength of the laser beam in the range of 0.4 to 1.2 μm. There is not particular restriction on the method of forming the ink layer 32; the ink layer 32 may be formed by a known printing method, such as a gravure printing method, an offset printing method or a silk screen printing method. The ink layer 32 may be formed over the entire surface of the transparent polymeric film 31 or only portions of the surface of the transparent polymeric film 31 to be irradiated with the laser beam. The layer 35 which is not processed by the laser beam and the laser beam transmitting layer 36 which transmits the laser bean and is not processed by the laser beam may be a film of a polyester resin, a polyamide resin, a polypropylene resin or the like, and a heat-sealing film of a polypropylene resin, an ethylene-vinyl-acetate copolymer or the like, respectively.

The laser beam to be used for producing the covering sheets 20 shown in FIGS. 4 and 5 may be a visible near infrared laser beam of a wavelength in the range of 0.4 to 1.2 μm. A laser beam emitted by an argon laser, a semiconductor laser a YAG laser or the like is particularly preferable. The laser beam may be either a pulse laser beam or a continuous laser beam. The output capacity per unit area of the laser may selectively be determined taking into consideration the speed of processing the covering sheet 20. The sheet for forming the covering sheet 20 may be irradiated with the laser beam by fixing the laser beam and moving the sheet for forming the covering sheet 20 to form straight cutting grooves or the sheet for forming the covering sheet 20 is scanned with the laser beam to form the cutting grooves in a desired pattern. The cutting grooves may be formed in a pattern of straight lines, curved lines, continuous lines or intermittent lines, such as dotted lines.

A 12 μm thick oriented polyethylene terephthalate film (OPET film) is used for forming the covering sheet 20 provided with the cut layers. The oriented polyethylene terephthalate film is coated with a polyester anchor coating agent (AC) in 1 g/m$^2$, and a 13 $\mu$m thick PE layer is formed by extruding a polyethylene resin (PE resin) to produce a laminated film consisting of a 12 $\mu$m thick OPET layer, a 1 $\mu$m thick AC layer and a 13 $\mu$m thick PE layer. The laminated film is irradiated with a $CO_2$ laser beam having a wavelength of 10.6 $\mu$m (943 cm$^2$) so that portions of the OPET layer (cut layer) are evaporated in a pattern of circular rings of 9 mm in inside diameter, 0.3 mm in width and 12 $\mu$m in depth to form circular cutting grooves. After the cutting grooves have been formed, the PE layer is coated with a heat-sealing layer to complete the covering sheet 20.

The covering sheet 20 may be produced by coating a 12 $\mu$m thick oriented polyethylene terephthalate film (OPET film) with a polyethylene anchor coating agent (AC) in 1 g/m$^2$, laminating a 15 $\mu$m thick polypropylene film (PP film) to the OPET film by dray lamination to form a laminated film of a 12 $\mu$m thick OPET layer, a 1 $\mu$m thick AC layer and a 15 $\mu$m thick PP layer, and irradiating the laminated film with a $CO_2$ laser beam.

(5) Porous plastic film

① The covering sheet 20 is produced by forming many cuts, such as minute pores, in a plastic film, and coating the plastic film by extruding a molten resin over the plastic film so as to cover the minute pores.

This covering sheet 20 is produced by forming many minute pores in a plastic film and covering the minute pores with the molten resin. Therefore, the covering sheet 20 can easily be torn along lines connecting the minute pores.

The plastic film is a polyethylene terephthalate film or a polypropylene film. An oriented plastic film is preferable, and biaxial oriented film is most preferable.

A minute pore forming method passes a plastic film through a nip between a metal roller having a circumference finished by sand blasting in a morphology like the surface of sandpaper, and a rubber roller. Another pore forming method forms minute pores in a plastic film with hot needles.

The plastic film is coated with a resin by extruding the molten resin after the minute pores have been formed therein. An olefine resin, such as a polyethylene resin or a polypropylene resin, is suitable for coating the porous plastic film.

The covering sheet 20 may be provided with a heat-sealing layer.

The heat-sealing layer is a generally used heat-sealing layer, such as an olefine resin layer, for example, a layer of a polyethylene resin or a polypropylene resin, a polyester resin layer or an urethane-modified polyester resin layer.

The covering sheet 20 may further be provided with a gas barrier layer impermeable to gases, such as a plastic layer of a polyvinyl vinylidene resin or an ethylene-vinylalcohol copolymer, or an inorganic evaporated layer, such as a silica layer deposited by evaporation.

The covering sheet 20 may further be provided with a printed layer formed by printing an printing ink. The printed layer forms marks and characters expressing a trade name, a manufacturer's name, a name of sales company and instructions for the contents of the package. The printed layer may be formed in any portion that does not touch the contents. The printed layer may be formed, for example, between the porous plastic film provided with many minute pores, and the coating layer formed by extruding a molten resin over the porous plastic film.

② The covering sheet 20 may be a laminated plastic structure having a layer of a plastic film provided with cuts formed by a metallic cutting edge.

The covering sheet 20 is torn along the cutting grooves 20*a* to separate each blister 11 from the package. Then, the embossed hollow 12 is crushed to push the tablet 15 so that the section of the covering sheet 20 is torn by the tablet 15, and the tablet 15 is taken out from the embossed hollow 12. Since the covering sheet 20 is made of an easily tearable material, the section of the covering sheet 20 can easily be torn and the tablet 15 can easily be taken out of the embossed hollow 12.

It occurs sometimes that the tablet 15 is not taken out from the embossed hollow 12 of the blister 11, and the blister 11 and the section of the covering sheet 20 packaging the tablet 15 are swallowed. Since the flanges 13 of the separate blisters 11 formed by embossing the hard, relatively thick sheet are bonded to the covering sheet, and a section of the covering sheet 20 covering each blister 11 and having a size greater than that of the flange 13 is torn off the covering sheet 20 to separate the blister 11 from the package, the circumferential edge of the flange 13 is not exposed. When the flange 13 is formed in a circular shape, the flange 13 is not injure the internal organs even if the edge of the flange 13 is exposed. Although the section of the covering sheet 20 has a rectangular shape, the section of the covering sheet 20 will not injure the internal organs and the fingers because the covering sheet is soft and thin.

Although the blisters 11 of the package in this embodiment are formed by processing a sheet of a PVC resin, the blisters 11 may be formed by processing a sheet of the same material as that of the covering sheet 20 specified in (4) or (5).

The blisters 11 may be formed by processing the laminated sheet shown in FIG. 4 consisting of the transparent polymeric film 31, the ink layer 32, the transparent polymeric film 31 and the layer 35 which is not processed by a laser beam.

The blisters 11 may be formed by processing the laminated sheet shown in FIG. 5 consisting of the layer 36 which transmits a laser beam and is not processed by the laser beam, the transparent polymeric film 31, the ink layer 32, the transparent polymeric film 31 and the layer 35 which is not processed by the laser beam.

The blisters 11 may be formed by processing a porous plastic film formed by forming many minute pores in a plastic film and coating the plastic film provided with many minute pores with a molten resin so as to cover the minute pores.

When the blisters 11 are formed by processing a sheet of the material specified in (4) forming the covering sheets shown in FIGS. 4 and 5, or the porous plastic sheet coated with the molten resin so as to cover the minute pores for forming the covering sheet 20 specified in (5), the blister 11 or the section of the covering sheet 20 may be broken to take out the tablet 15. The covering sheet 20 may be a sheet which cannot be torn, and the blister 11 may be broken to take out the tablet 15.

EXAMPLES

Example 1

A material forming a covering sheet 20 of Example 1 corresponds to the composite material specified in (1) consisting of a polyolefine resin and inorganic fillers. The covering sheet 20 is a sheet of a composite material containing 54% by weight PP resin (E409TS available from Tonen Kagaku), 45% by weight talc having a mean particle size of 15 $\mu$m, and 1.0% by weight titanium oxide having a mean particle size of 0.4 $\mu$m.

A 65 $\mu$m thick film was formed by extruding this composite material by a T-die extrusion process, and the film was used as the covering sheet 20. The covering sheet 20 was bonded to the flanges 13 of the blisters 11 containing tablets 15 by a heat-sealing process at a heat-sealing temperature in the range of 145 to 150° C. to produce a package 10.

The package 10 was not curled and had a satisfactory appearance. When the embossed hollow 12 is crushed by the tip of a finger to push the table 15, the section of the covering sheet 20 bonded to the flange 13 of the blister 11 was torn in the substantially middle portion thereof and the tablet 15 was taken out easily. If the blister 11 and the covering sheet 20 are made of the same PP resin, no problem arises in the disposal and the recycling of the package because the material of the blisters 11 does not contain any special material, such as an aluminum foil.

Example 2

A material forming a covering sheet 20 of Example 2 corresponds to the film provided with cuts specified in (5). The covering sheet 20 was formed by the following method. A 12 $\mu$m thick biaxial oriented polyethylene terephthalate film was passed through a nip between a metal roller having a circumference finished by sand blasting in a morphology like the surface of sandpaper, and a rubber roller to form many minute pores in the biaxial oriented polyethylene terephthalate film.

Then, the biaxial oriented polyethylene terephthalate film provided with the minute pores was coated with a molten polyethylene resin by extrusion so as to cover the minute pores. The water vapor permeability of the porous film thus produced was 4 g/m$^2$/day.

Subsequently, the polyester heat-sealing layer was laminated to the biaxial oriented polyethylene terephthalate film to obtain the covering sheet 20.

The tablet 15 can easily be taken out from one of the blister 11 of a package 10 formed by bonding the covering sheet 20 to the flanges 13 of the blisters 11 containing tablets 15 by crushing the blister 11 to push the tablet 15 against the section of the covering sheet 20 so that the section of the covering sheet is torn.

Since the covering sheet 20 is formed by forming the many minute pores in the plastic film and coating the plastic film by extruding a molten resin so as to cover the minute pores, the strength of the plastic film is reduced by the minute pores.

Accordingly, the covering sheet 20 can easily be torn simply by pressing the tablet 15 against the covering sheet 20.

Since the many minute pores formed in the plastic film are covered by extruding the molten resin so as to coat the plastic film, the many minute pores do not affect adversely to the barrier function of the covering sheet 20 at all.

Since there is no possibility that pinholes, which are liable to be formed in aluminum foils, are formed in the covering sheet 20, the covering sheet 20 has highly reliable moisture-proof property which improves the shelf life of the contents.

The highly transparent covering sheet 20 enables the automatic optical detection of the contents.

The covering sheet 20 can be incinerated without producing any residue and can easily be disposed of or can be recycled, which is advantageous in view of resources conservation.

Example 3

A material forming a covering sheet 20 of Example 3 corresponds to the film provided with cuts specified in (5).

The covering sheet 20 is produced by the following method. A laminated film of an oriented polyethylene terephthalate (OPET) film, a polyester anchor coating agent (AC) and an extruded polyethylene (PE) film was prepared, and the surface of the OPET film was coated with a polyester anchor coating agent (AC) in 1 g/m$^2$, and a high-impact type polystyrene (HIPS) sheet was laminated to the laminated sheet by dry lamination to obtain a laminated sheet of a 100 $\mu$m thick HIPS layer, a 1 $\mu$m thick C layer, a 12 $\mu$m thick OPET layer, a 1 $\mu$m thick AC layer and a 13 $\mu$m thick PE layer.

Circular cuts of 9 mm in diameter and 110 $\mu$m in depth were formed in the surface of the laminated sheet on the side of the HIPS layer with a metal edge of 9 mm in diameter, and the surface of the laminated sheet on the side of the PE layer was coated with a PVA heat-sealing agent in 4 g/m$^2$ by a gravure coating method to obtain the covering sheet 20.

The covering sheet or the blister in accordance with the present invention is easily tearable, the contents can easily be taken out of the blister. Since the blisters are formed separately and the flanges of the blisters are bonded to the covering sheet, the circumferential edge of the flange of the hard blister is not exposed when the blister is separated from the package by tearing the covering sheet. Therefore, the fingers will not be injured by the circumferential edges of the flanges of the hard blister when handling the package, and the internal organs will not be injured by the circumferential edge of the flange even if the unit package consisting of the blister, the tablet and the section of the covering sheet is swallowed by mistake.

THIRD EMBODIMENT

A third embodiment of the present invention will be described with reference to FIGS. 6 to 12, in which parts like or corresponding to those of the first embodiment shown in FIGS. 1 to 3 are designated by the same reference characters and the description thereof will be omitted.

Figure 6:
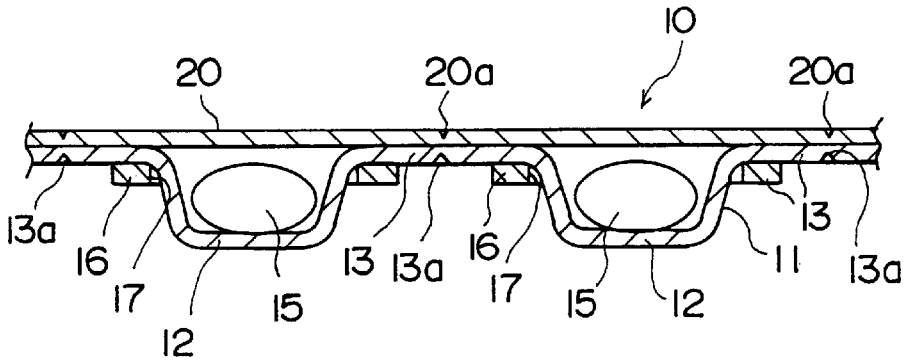
FIG. 6 is a sectional side view of a package in a third embodiment according to the present invention.
Figure 7:
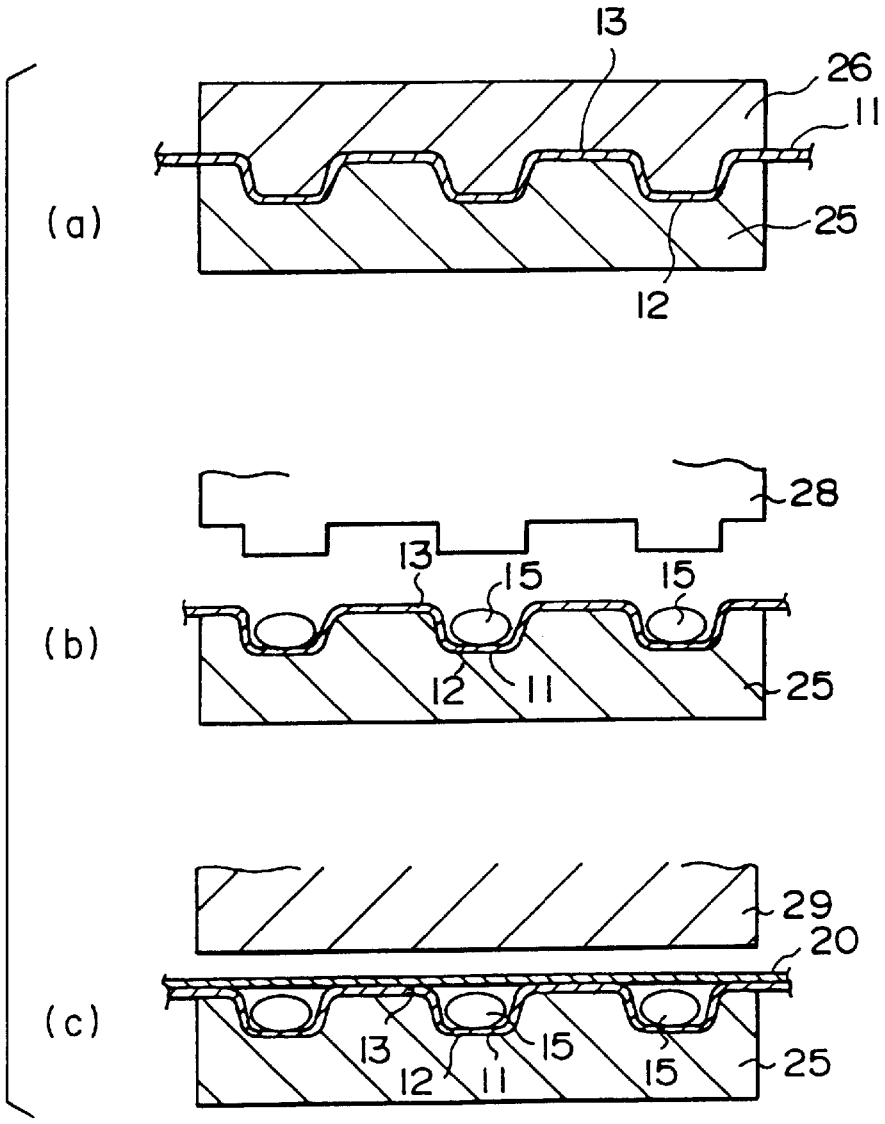
FIG. 7 is a schematic sectional view of assistance in explaining a method of manufacturing the package in the third embodiment.
Figure 8:
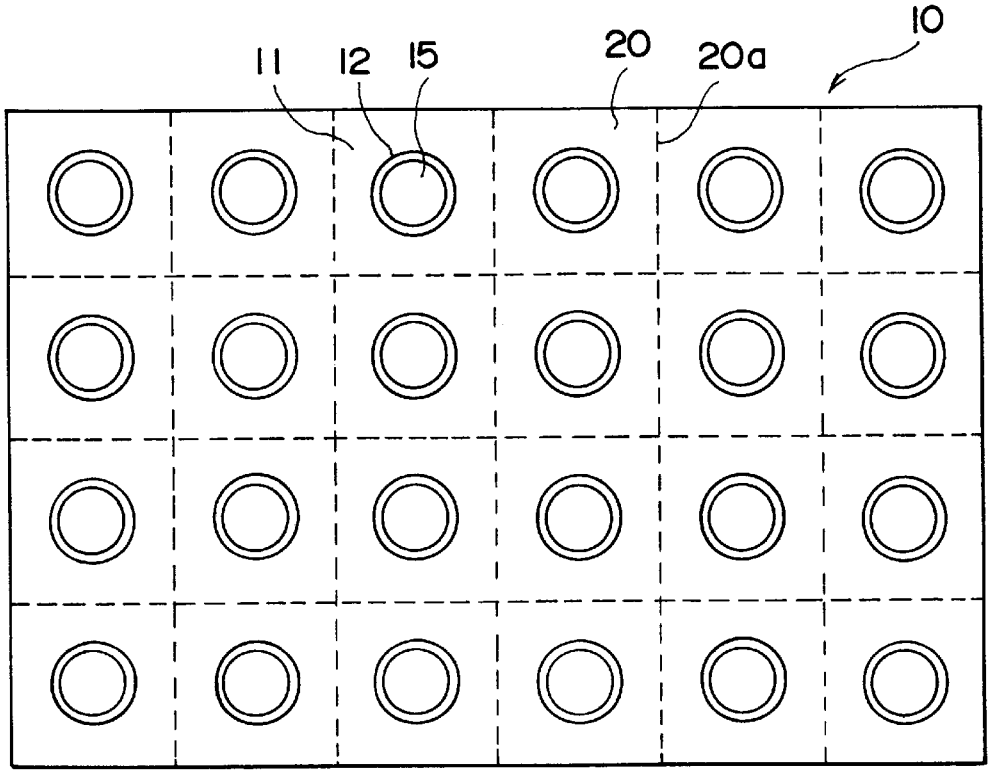
FIG. 8 is a plan view of the package in the third embodiment, in which a covering sheet is supposed to be transparent for convenience.

Referring to FIGS. 6 to 8, a package 10 in accordance with the present invention comprises a blister 11 having a plurality of embossed hollows 12 with open upper ends, for containing tablets 15, and flanges 13 extending around the open ends of the embossed hollows 12, and a covering sheet 20 bonded to the upper surfaces of the flanges 13 of the blister 11. A ring 16 having a center hole (through hole) 17 is bonded to the lower surface of each flange 13, i.e., a surface opposite the surface to which the covering sheet 20 is bonded. Each embossed hollow 12 of the embossed blister 11 is fitted in the center hole 17 of the ring 16 so that the center hole 17 of the ring 16 corresponds to the upper open end of the embossed hollow 12.

As mentioned previously, the blister 11 has the embossed hollows 12 containing the tablets 15 and the flanges 13 extending around the open ends of the embossed hollows 12, and the flanges 13 of the blister 11 are bonded to the covering sheet 20 by heat-sealing.

For example, the blister 11 has the twenty-four embossed hollows 12 which are arranged in four rows as shown in FIG. 8, and tablets 15 are contained in the embossed hollows 12, respectively. In FIG. 8, the covering sheet 20 is supposed to be transparent for convenience.

Tearing incisions 13*a* and 20*a* are formed in the flanges 13 of the blister 11 and the covering sheet 20, respectively, to facilitate the separation of each unit blister package from the package. The flanges 13 of the blister 11 and the covering sheet 20 may be provided with perforations instead of the tearing incisions 13*a* and 201.

The materials of the components of the package 10 will be described hereinafter. The blister 11 is formed by embossing a sheet of a thermoplastic elastomer or a soft resin. The blister 11 is also soft.

The covering sheet 20 may be a relatively thin laminated sheet, such as a 10 to 25 $\mu$m thick laminated sheet having an OP layer, an aluminum layer and a heat-sealing layer.

The heat sealing layer may be formed of, for example, a thermoplastic resin, such as a vinyl acetate resin, a PVA resin, a polyvinyl butyral resin, a polyvinyl chloride resin, a polyamide resin, a polyester resin, a polyolefine resin, a polyacrylic resin, a cellulose ester resin or a polyethylene resin, a copolymer of those resins, a mixture of those resins or an acid modified resin.

The covering sheet 20 is relatively thin and relatively soft.

The relatively soft blister 11 and the relatively soft covering sheet 20 are those which have a certain degree of plasticity and can be wound around a bobbin of a predetermined diameter.

The rings 16 are harder than the blister 11 and the covering sheet 20, are made of a macromolecular compound or a shape memory metal, and have a transition temperature in the range of 30 to 40° C. When the ring 16 is heated at the transition temperature in the range of 30 to 40° C., the ring 16 shrinks. Possible shape memory metals are, for example, a Ti—Ni alloy (Nityl), a Cu—Zn—Al allow (Petalloy), an In—Ti alloy, a Ni—Al alloy and a Mn—Cu alloy. Possible macromolecular compounds are a polyurethane resin (Dialy available from Mitsubishi Heavy Industries Ltd.) and a polynorbolnen resin (Nosolex available from Nippon Zeon).

The ring 16 may be made of a water-soluble material, such as a PVA resin (polyvinyl alcohol resin), a polyacrylic acid resin, hydroxyethyl cellulose, hydroxypropyl cellulose, a polyethylene glycol resin, a poly-N-vinyl acetoamide resin, and Paogen (Daiichi Kogyo Seiyaku). If the ring 16 is made of a water-soluble material, the ring 16 dissolves if the ring 16 is swallowed by mistake.

A method of manufacturing the package 10 will be described with reference to FIGS. 7(*a*)–(*c*). Referring to FIGS. 7(*a*)–(*c*), a sheet, for example, a soft thermoplastic sheet, is placed between a female die (lower die) 25 and a male die (upper die) 26, and then the a plug assist vacuum forming between the female die 25 and the male die 26 to obtain an embossed sheet provided with the plurality of embossed hollows 12 and having flanges 13 connecting the embossed hollows 12 (FIG. 7(*a*)).

The female die 25 holding the hollows 12 is transported to a tablet dispensing machine 28, and then the tablet dispensing machine puts the tablets 15 in the embossed hollows 12 held on the female die 25.

Then, the female die 25 holding the blister 11 is transported to a heat-sealing machine 29, and then the heat-sealing machine 29 bonds the covering sheet 20 consisting of, for example, an OP layer, an aluminum layer and a heat-sealing layer to the flanges 13 of the blister 11 by heat-sealing to seal the embossed hollows 12 of the blisters 11 (FIG. 7(*c*)). At the same time, the tearing incisions 13*a* and 20*a* are formed in the flanges 13 and the covering sheet 20, respectively. Subsequently, the circular rings 16 are bonded to the lower surfaces of the flanges 13 to complete the package 10 shown in FIGS. 6 to 8. The rings 16 may be bonded to the lower surfaces of the flanges 13 before putting the tablets 15 in the embossed hollows 12 of the blister 11.

When using the tablet 15, the blister 11 and a section of the covering sheet 20 are torn along the tearing incisions 13*a* and 20*a* to separate a unit blister package having the embossed hollow 12 from the package 10. Then, the embossed hollow 12 is crushed by the tip of a finger to push the tablet 15 against the section of the covering sheet 20, so that the section of the covering sheet 20 covering the embossed hollow 12 is broken and the tablet 15 is taken out from the embossed hollow 12 of the blister 11. Although the blister 11 and the covering sheet 20 are made of soft materials, the force exerted on the blister 11 by the tip of a finger works effectively because the hard ring 16 is bonded to the flange 13 of the blister 11 and hence the section of the covering sheet 20 can easily be broken by the tablet 15. If the ring 16 is omitted and the unit blister package is formed only of the soft blister 11 and the section of the soft covering sheet 20, the blister 11 and the section of the covering sheet 20 are only bent when the pressure is applied to the blister 11 defining the embossed hollow 12 and it is difficult to break the section of the covering sheet 20 by the tablet 15.

The ring 16 of the present invention enables the tablet 15 to break the section of the covering sheet 20 easily.

Incidentally, it is possible that the tablet 15 is not taken out from the embossed hollow 12 of the blister 11, and the blister 11 containing the tablet 15 and the ring 16 are swallowed. Although the flange 13 of the blister 11 and the section of the covering sheet 20 cut along the tearing incisions 13*a* and 20*a* are rectangular, the internal organs will not be injured by the blister 11 and the section of the covering sheet 20 because the same are made of soft materials. Furthermore, the blister 11 and the section of the covering sheet 20 will not injure the fingers.

When the ring 16 is made of a shape memory material having a transition temperature in the range of 30 to 40° C., the ring 16 is heated to the transition temperature in the user's body and shrinks. When the ring 16 is made of a shape memory metal, the ring 16 can easily be located by X-ray inspection when swallowed into the user's body.

When the ring 16 is made of a water-soluble material, the ring 16 dissolves in the user's body and is not injure the internal organs.

Figure 9:
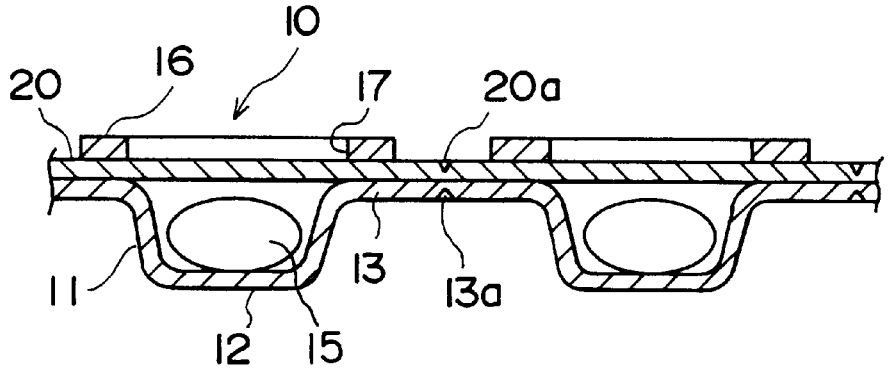
FIG. 9 is a sectional side view of a modification of the package in the third embodiment.

A modification of the foregoing embodiment of the present invention will be described with reference to FIGS. 9 and 10. In the embodiment shown in FIGS. 6 to 8, the ring 16 is attached to the lower surface of the flange of the blister 11. The ring 16 may be attached to the outer surface of the covering sheet 20, i.e., the surface opposite the surface bonded to the flange 13, as shown in FIG. 9. As shown in FIG. 9, the through hole 17 of the ring 167 corresponds to the open end of the embossed hollow 12. The rings 16 are bonded to the covering sheet 20 after bonding the covering sheet 20 to the blister 11 by heat-sealing. The rings 16 may be bonded to the covering sheet 20 before bonding the covering sheet 20 to the blister 11.

Figure 10:
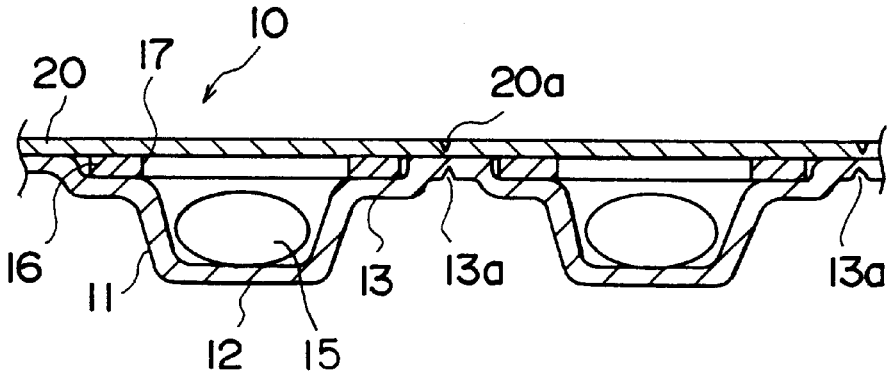
FIG. 10 is a sectional side view of another modification of the package in the third embodiment.

The rings 16 may be bonded to the upper surfaces of the flanges 13 of the blister 11 as shown in FIG. 10. In FIG. 10, the through hole 17 of the ring 16 corresponds to the open end of the embossed hollow 12 of the blister 11. The rings 16 are bonded to the flanges 13 of the blister 11, and then the covering sheet 20 is bonded to the embossed blister 11 by heat-sealing. The rings 16 may be bonded to the inner surface of the covering sheet 20 in advance, and then the covering sheet 20 may be bonded to the flanges 13 of the blister 11 by heat-sealing.

A practical example of the present invention will be described with reference to FIGS. 11 and 12. A practical example shown in FIGS. 11 and 12 is a package packet produced by winding a package 10 similar to that of FIG. 6;

comprising a blister 11 having embossed hollows 12 arranged in a single row in a roll and a covering sheet 20, and packing the roll of the package 10 in a container 1. As mentioned above, the package 10 has the blister 11 of a soft material and the covering sheet 20 of a soft material. Therefore, the package 10 can easily be wound in a roll.

Figure 11:
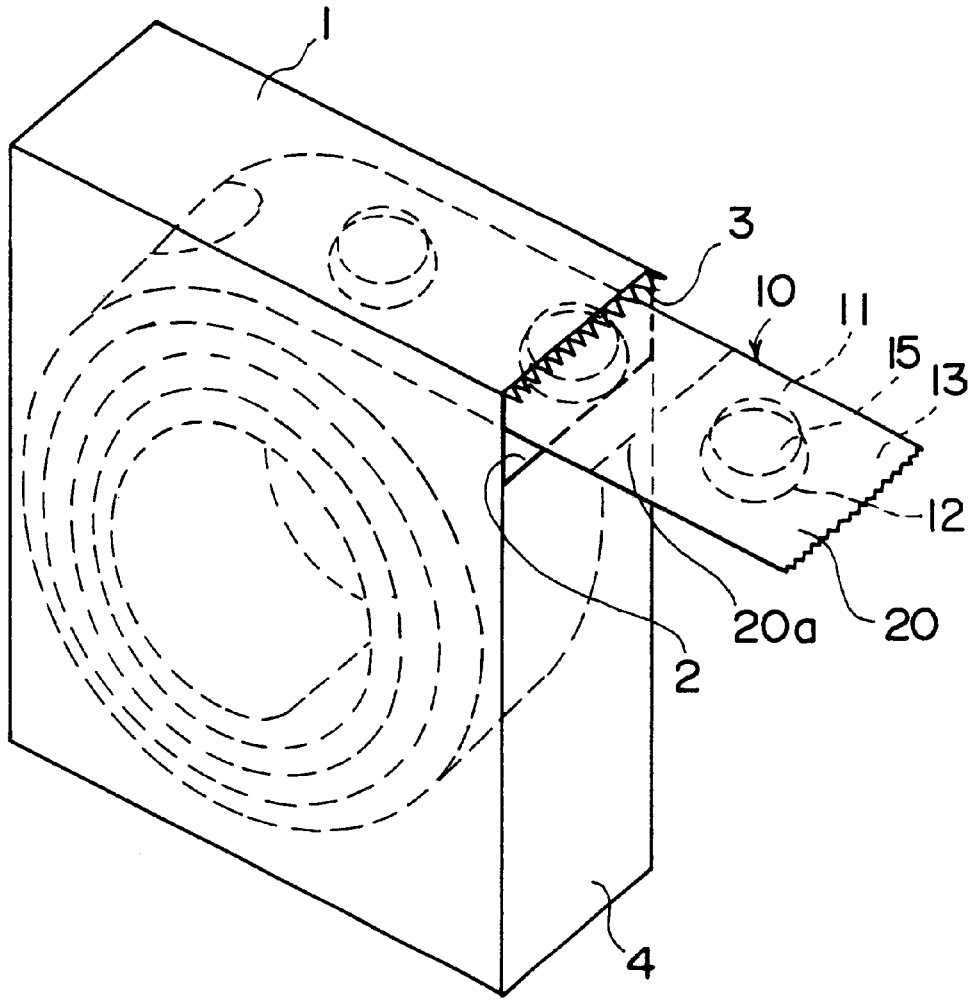
FIG. 11 is a perspective view of the package in the third embodiment in a mode of practical application.
Figure 12:
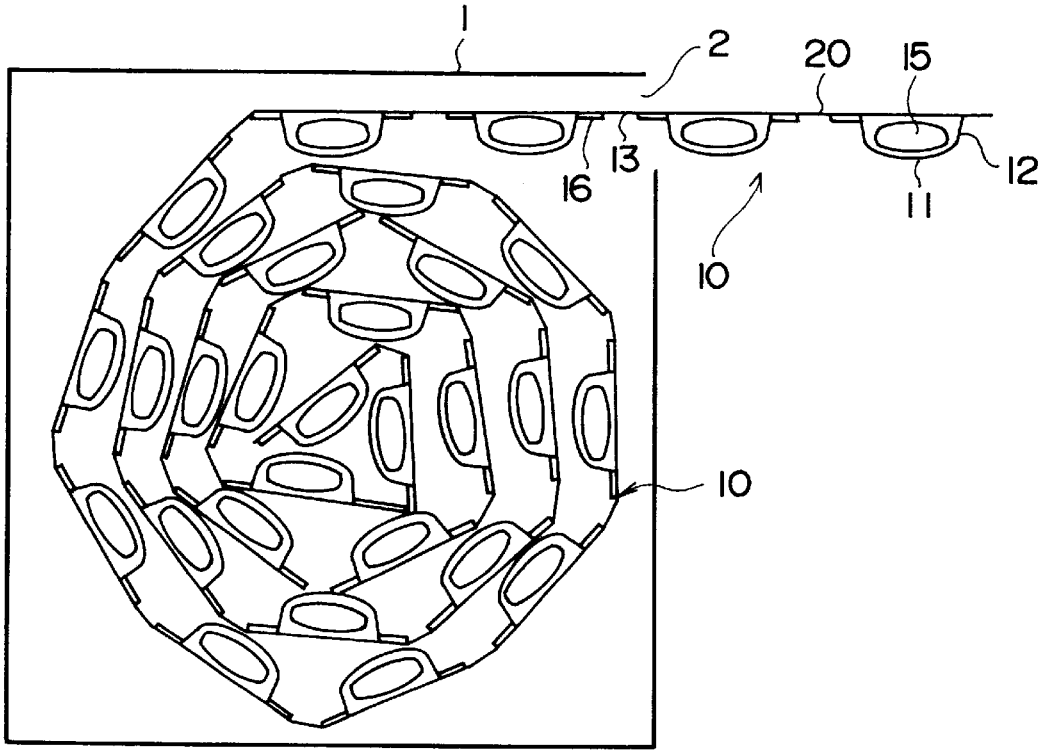
FIG. 12 is a sectional side view of the package of FIG. 11 in a mode of practical application.

As shown in FIGS. 11 and 12, the container 1 has a boxed shape and is provided with an opening 2 in an upper portion of a side wall 4 thereof. The package 10 is pulled out through the opening 2. A cutting edge 3 is fixed to the upper edge of the opening 2 of the container 1. Although the container 1 shown in FIGS. 11 and 12 is fixedly provided with the cutting edge 3, the cutting edge 3 is not necessarily indispensable; the container 1 may be provided with the cutting edge 3 when necessary.

When using the package 10, a portion of the package 10 is pulled out through the opening 2 from the container 1, the blister 11 having the embossed hollow 12, and the section of the covering sheet 20 of one unit blister package are cut off the package 10 along the tearing incisions 13*a* and 20*a* with the cutting edge 3. Then, the blister 11 is crushed by the tip of a finger to push the tablet 15. The force exerted on the blister 11 is sustained by the ring 16 so that the section of the covering sheet 20 sealing the embossed hollow 12 is torn, and the tablet 15 is taken out from the embossed hollow 12 of the blister 11.

In this packet, the package 10 having the blister 11 and the covering sheet 20 is wound in a compact roll, and the roll of the package 10 can compactly be contained in the container 1.

As is apparent from the foregoing description, the package of the present invention is safe and, even if the unit blister package of the package is swallowed, the internal organs will not be injured by the edges of the blister. Since the hard ring sustains the force exerted on the blister by the tip of a finger, the section of the covering sheet can easily be broken by the article contained in the blister and the article contained in the blister can easily be taken out.

FOURTH EMBODIMENT

A fourth embodiment of the present invention will be described with reference to FIGS. 13 to 18, in which parts like or corresponding to those of the first embodiment shown in FIGS. 1 to 3 are designated by the same reference characters and the description thereof will be omitted.

Figure 13:
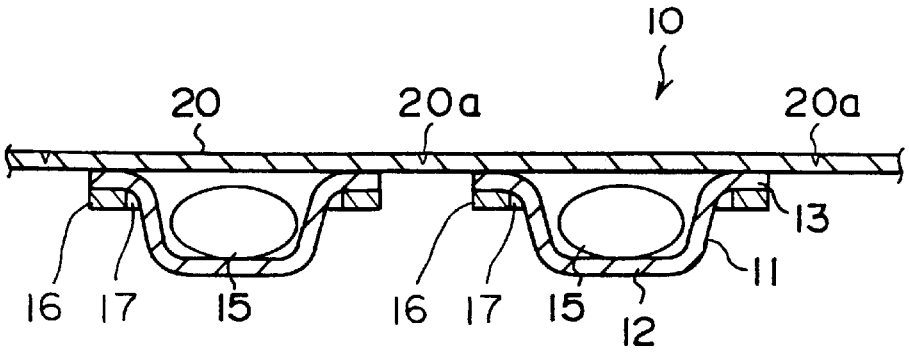
FIG. 13 is a sectional side view of a package in a fourth embodiment according to the present invention.

Referring to FIG. 13, a package 10 of the present invention comprises a plurality of blisters 11 having embossed hollows 12 and flanges 13 extending around the open upper ends of the embossed hollows 12, and a covering sheet 20 bonded to the upper surface of the flanges 13 of the blisters 11 by heat-sealing. A ring 16 having a through hole 17 is bonded to the lower surface of each flange 13, i.e., the surface opposite the surface bonded to the covering sheet 20. The blister 11 having the embossed hollow 12 is fitted in the through hole 17 of the ring 16 so that the upper open end of the embossed hollow 12 corresponds to the through hole 17 of the ring 16.

The blisters 11 defining the embossed hollows 12 containing tablets 15 are formed separately. The flanges 13 of the blisters 11 are bonded to the covering sheet 20 by heat-sealing.

The flange 13 of each blister 11 has a circular edge and hence the embossed hollow 12 containing the tablet 15 has a circular shape accordingly (FIG. 3). The edge of the flange 13 may be formed in an elliptic shape or a polygonal shape having rounded corners.

The circumferential edge of the flange is formed in a safe shape by straight lines, curves or a combination of straight lines and curves, so that the internal organs will not be injured by the flange 13 even if the blister 11 is swallowed together with the tablet 15.

Tearing incisions 20*a* are formed in the covering sheet 20 to tear the covering sheet 20 into sections respectively corresponding to the blisters 11. The covering sheet 20 may be provided with perforations instead of the tearing incisions 20*a*.

The materials of the components of the package 10 will be described. The blisters 11 of the package 10 are made of a soft, thermoplastic elastomeric resin, and the blisters 11 are relatively soft.

The covering sheet 20 is, for example, a relatively thin laminated sheet of a thickness in the range of 10 to 25 $\mu$m consisting of an OP layer, an aluminum layer and a heat-sealing layer.

The heat-sealing layer may be formed of a thermoplastic resin, such as a polyvinyl acetate resin, a PVA resin, a polyvinyl butyral resin, a polyvinyl chloride resin, a polyamide resin, a polyester resin, a polyolefine resin, a polyacrylic resin, a cellulose ester or a polyethylene resin, a copolymers of those resins, a mixture of those resins or an acid modified resin.

The covering sheet 20 is relatively soft because the same is relatively thin.

The relatively soft blisters 11 and the relatively soft covering sheet 20 are those which have a certain degree of plasticity and can be wound around a bobbin of a predetermined diameter.

The rings 16 are harder than the blisters 11 and the covering sheet 20, are made of a macromolecular compound or a shape memory metal, and have a transition temperature in the range of 30 to 40° C. When the ring 16 is heated at the transition temperature in the range of 30 to 40° C., the ring 16 shrinks. Possible shape memory metals are, for example, a Ti—Ni alloy (Nityl), a Cu—Zn—Al allow (Petalloy), an In—Ti alloy, a Ni—Al alloy and a Mn—Cu alloy. Possible macromolecular compounds are a polyurethane resin (Dialy available from Mitsubishi Heavy Industries Ltd.) and a polynorbolnen resin (Nosolex available from Nippon Zeon).

The ring 16 may be made of a water-soluble material, such as a PVA resin (polyvinyl alcohol resin), a polyacrylic acid resin, hydroxyethyl cellulose, hydroxypropyl cellulose, a polyethylene glycol resin, a poly-N-vinyl acetoamide resin, and Paogen (Daiichi Kogyo Seiyaku). In the case the ring 16 is made of a water-soluble material, the ring 16 dissolves when the ring 16 is swallowed by mistake.

When using the tablet 15, the blister 11 and a section of the covering sheet 20 are torn along the tearing incisions 13*a* and 20*a* to separate a unit blister package having the blister 11 from the package 10. Then, the blister 11 having the embossed hollow 12 is crushed by the tip of a finger to push the tablet 15 against the section of the covering sheet 20, so that the section of the covering sheet 20 covering the embossed hollow 12 is broken and the tablet 15 is taken out from the embossed hollow 12 of the blister 11. Although the blister 11 and the covering sheet 20 are made of soft materials, the force exerted on the blister 11 by the tip of a finger works effectively because the hard ring 16 is bonded to the flange 13 of the blister 11 and hence the section of the covering sheet 20 can easily be broken by the tablet 15. If the ring 16 is omitted and the unit blister package is formed only of the soft blister 11 and the section of the soft covering sheet 20, the embossed blister 11 and the section of the covering sheet 20 are only bent when the pressure is exerted on the blister 11 defining the embossed hollow 12 and it is difficult to break the section of the covering sheet 20 by the tablet 15.

The ring 16 of the present invention enables the tablet 15 to break the section of the covering sheet 20 easily.

Incidentally, it is possible that the tablet 15 is not taken out from the embossed hollow 12 of the blister 11, and the blister 11 containing the tablet 15 and the ring 16 are swallowed. Since the blister 11 of the soft material is formed separately and the flange 13 is bonded to the covering sheet 20, the circumferential edge of the flange is not exposed. Since the circumferential edge of the flange 13 has a circular shape, the flange 13 will not injure the internal organs even if the circumferential edge of the flange 13 is exposed. Although the section of the covering sheet 20 cut along the tearing incisions 20*a* is rectangular, the internal organs will not be injured by the section of the covering sheet 20 because the same is made of a soft material. Furthermore, the section of the covering sheet 20 will not injure the fingers.

When the ring 16 is made of a shape memory material having a transition temperature in the range of 30 to 40° C., the ring 16 is heated to the transition temperature in the user's body and shrinks. When the ring 16 is made of a shape memory metal, the ring 16 can easily be located by X-rain inspection when swallowed into the user's body.

When the ring 16 is made of a water-soluble material, the ring 16 dissolves in the user's body and will not injure the internal organs.

Figure 14:
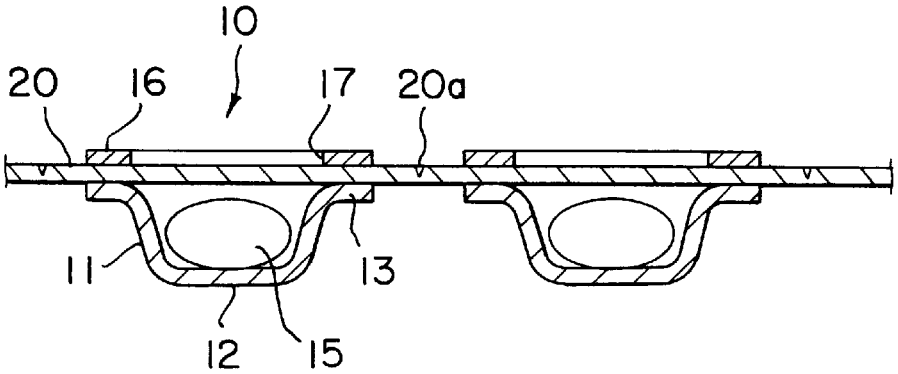
FIG. 14 is a sectional side view of a modification of the package in the fourth embodiment.
Figure 15:
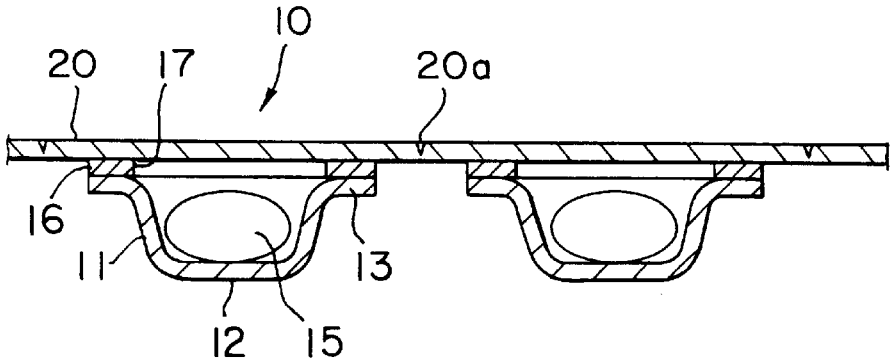
FIG. 15 is a sectional side view of another modification of the package in the fourth embodiment.

Modifications of the foregoing embodiment of the present invention will be described with reference to FIGS. 14 and 15. In the embodiment shown in FIG. 13, the ring 16 is bonded to the lower surface of the flange 13 of the blister 11. The ring 16 may be bonded to the outer surface of the covering sheet 20, i.e., the surface opposite the surface bonded to the flange 13, as shown in FIG. 14. In FIG. 14, the through hole 17 of the ring 16 corresponds to the open end of the embossed hollow 12. The rings 16 may be bonded to the covering sheet 20 after bonding the covering sheet 20 to the blisters 11 or may be bonded to the covering sheet 20 before bonding the covering sheet 20 to the blisters 11 by heat-sealing.

Figure 16:
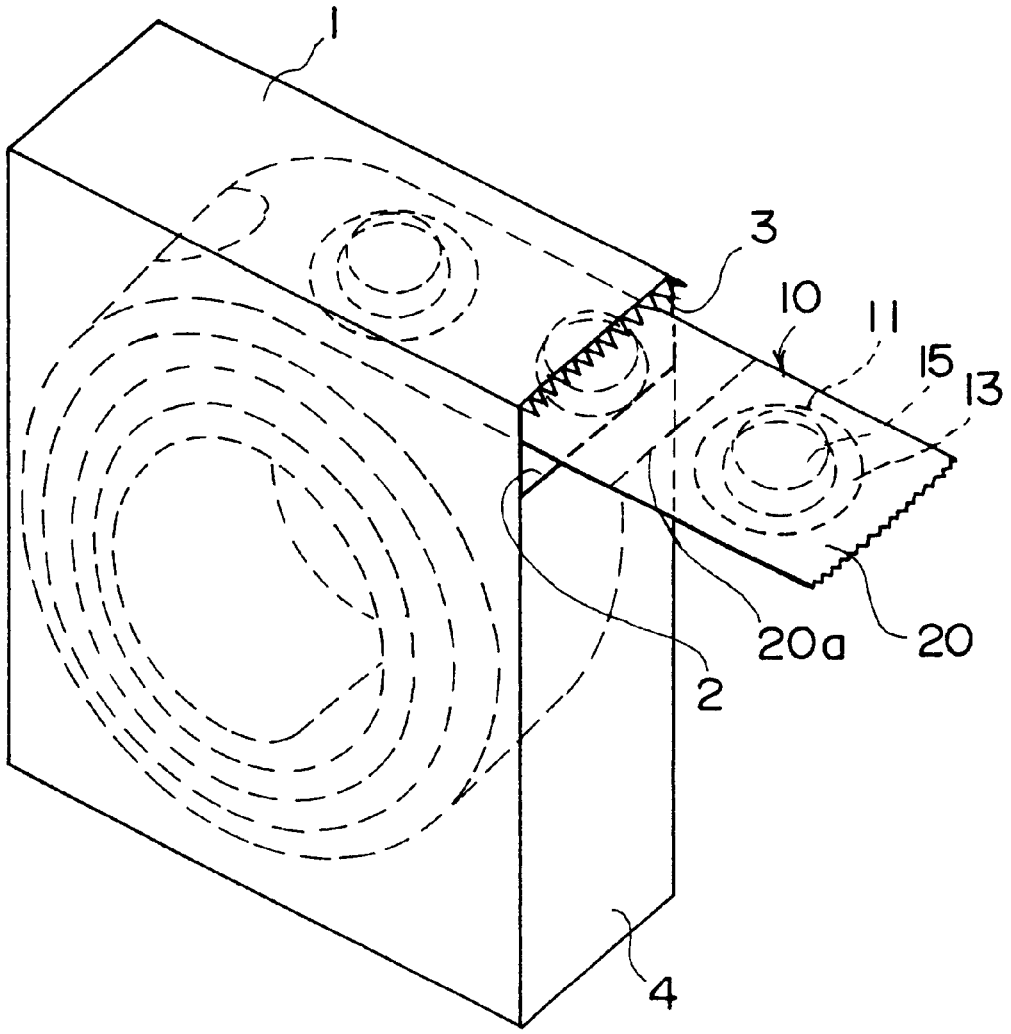
FIG. 16 is a perspective view of the package in the fourth embodiment in a mode of practical application.
Figure 17:
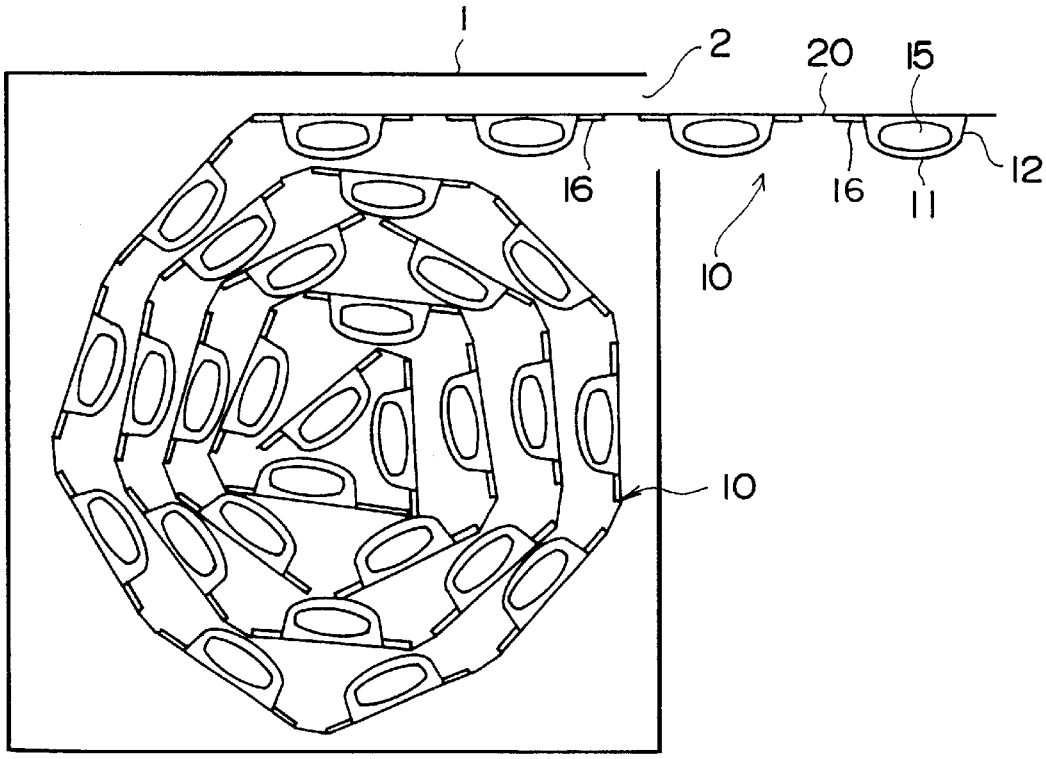
FIG. 17 is a sectional side view of the package of FIG. 16 in a mode of practical application.

A practical example of the present invention will be described with reference to FIGS. 16 and 17. A practical example shown in FIGS. 16 and 17 is a package packet produced by winding a package 10 similar to that of FIG. 13 comprising blisters 11 arranged in a single row in a roll, and packing the roll of the package 10 in a container 1. As mentioned above, the package 10 has the separate blisters 11 of a soft material and the covering sheet 20 of a soft material. Therefore, the package 10 can easily be wound in a roll.

As shown in FIGS. 16 and 17, the container 1 has the boxed shape and is provided with an opening 2 in an upper portion of a side wall 4 thereof. The package 10 is pulled out through the opening 2. A cutting edge 3 is fixed to the upper edge of the opening 2 of the container 1. Although the container 1 shown in FIGS. 16 and 17 is fixedly provided with the cutting edge 3, the cutting edge 3 is not necessarily indispensable; the container 1 may be provided with the cutting edge 3 when necessary.

When using the package 10, a portion of the package 10 is pulled out through the opening 2 from the container 1, the blister 11 is separated from the package 10 by cutting the covering sheet 20 along the tearing incision 20*a* with the cutting edge 3. Then, the blister 11 is crushed by the tip of a finger to push the tablet 15. The force exerted on the blister 11 is sustained by the ring 16 so that the section of the covering sheet 20 sealing the embossed hollow 12 is torn, and the tablet 15 is taken out from the embossed hollow 12 of the blister 11.

In this package packet, the package 10 having the blisters 11 and the covering sheet 20 is wound in a compact roll, and therefore the roll of the package 10 can compactly be contained in the container 1.

Figure 18:
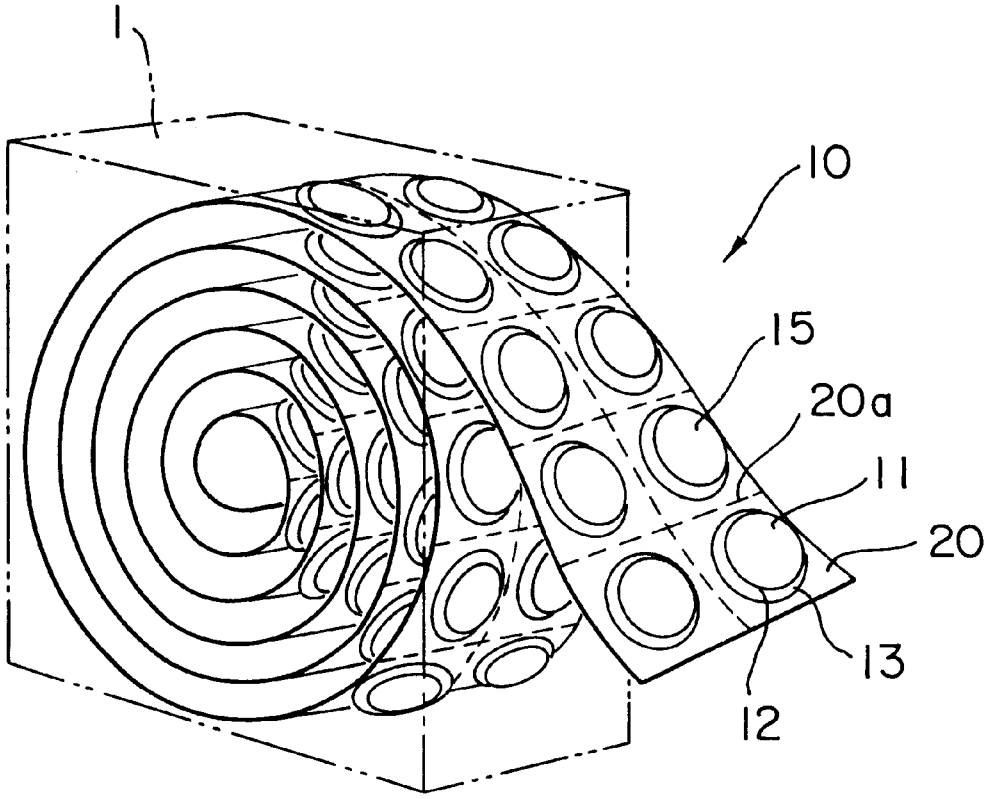
FIG. 18 is a perspective view of a package in another mode of practical application.

Another practical example of the present invention will be described with reference to FIG. 18. As shown in FIG. 18, a package 10 has blisters 11 arranged in two rows, and a covering sheet 20 bonded to the blisters 11. The package 10 is wound in a roll so that the blisters 11 containing tablets 15 are on the outer surface of the roll, and then the roll of the package 10 is packed in a container 1.

As is apparent from the foregoing description, the package of the present invention is safe and, even if the unit blister package of the package is swallowed, the internal organs will not be injured by the edges of the blister. Since the hard ring sustains the force exerted on the blister by the tip of a finger, the section of the covering sheet can easily be broken by the article contained in the blister and the article contained in the blister can easily be taken out.

FIFTH EMBODIMENT

A fifth embodiment according to the present invention will be described with reference to FIGS. 19 to 21, in which parts like or corresponding to those of the first embodiment shown in FIGS. 1 to 3 are designated by the same reference characters and the description thereof will be omitted.

Figure 19:
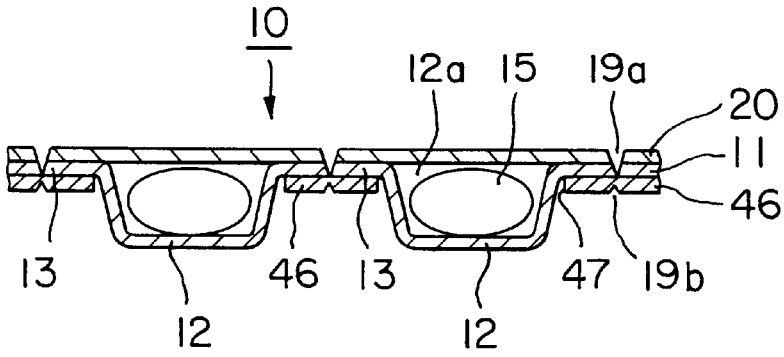
FIG. 19 is a sectional side view of a package in a fifth embodiment according to the present invention.

Referring to FIG. 19, a package 10 comprises a soft blister 11 having a plurality of embossed hollows 12 with open ends 12*a*, for containing articles, such as tablets 15, and flanges 13 extending around the open ends 12*a* of the embossed hollows 12, and a soft covering sheet 20 bonded to the upper surfaces of the flanges 13 by heat-sealing so as to cover the open ends 12*a* of the embossed hollows 12 of the blister 11.

A reinforcing paper sheet 46 having through holes 47 is placed on the lower surfaces of the flanges 13, i.e., the surfaces opposite the surfaces to which the covering sheet 20 is bonded. The embossed hollows 12 are fitted in the through holes 47 of the reinforcing paper sheet 46 so that the lower surfaces of the flanges 13 are seated on the reinforcing paper sheet 46. Therefore, the through holes 47 correspond to the upper open ends 12*a* of the embossed hollows 12, respectively.

Tearing incisions 19*a* are formed in the flanges 13 extending around the embossed hollows 12 and the covering sheet 20, and tearing incisions 19*b* are formed in the reinforcing paper sheet 46. The flanges 13 and the covering sheet 20 are torn along the tearing incisions 19*a* and the reinforcing paper sheet 46 is torn along the tearing incisions 19*b* to separate the embossed hollows 12 individually. Both the tearing incisions 19*a* and 19*b* need not necessarily be formed; only the tearing incisions 19*a* or 19*b* may be formed or perforations may be formed instead of the tearing incisions 19*a* and 19*b*.

Figure 20:
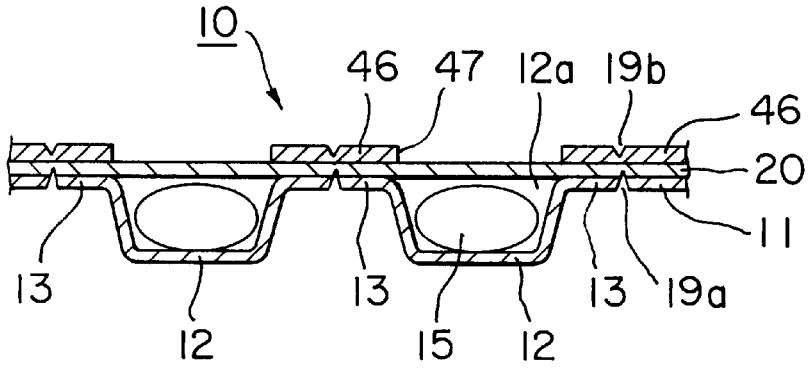
FIG. 20 is a sectional side view of a modification of the package in the fifth embodiment.

Referring to FIG. 20, a package 10 comprises a soft blister 11 having embossed hollows 12 with open ends 12*a*, for containing articles, such as tablets 15, and flanges 13 extending around the open ends 12*a* of the embossed hollows 12, and a soft covering sheet 20 bonded to the upper surfaces of the flanges 13 by heat-sealing so as to cover the open ends 12*a* of the embossed hollows 12 of the blister 11.

A reinforcing paper sheet 46 having through holes 47 respectively corresponding to the open ends 12*a* of the embossed hollows 12 is placed on the upper surface of the covering sheet 20 i.e., the surface opposite the surface to which the flanges 13 are bonded, so that the through holes 47 of the reinforcing paper sheet 46 correspond to the open ends 12*a* of the embossed hollows 12, respectively.

The package 10 shown in FIG. 20 is provided with tearing incisions 19*a* and 19*b* similar to those of the package 10 shown in FIG. 19.

Figure 21:
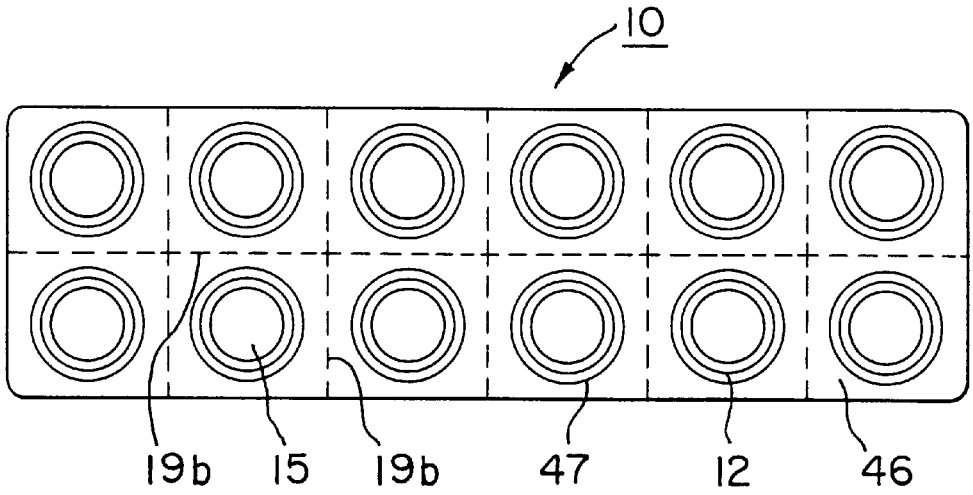
FIG. 21 is a bottom view of the package of FIG. 19.

FIG. 21 is a bottom view of the package 10 of FIG. 19. The package 10 has the twelve embossed hollows 12 respectively containing the tablets 15 arranged in two rows each of the six embossed hollows 12.

The adjacent embossed recesses 12 are demarcated by the tearing incisions 19*b* to enable a necessary number of the embossed recesses 12 to be torn off from the package 10.

There is no particular restriction on the arrangement of the embossed recesses 12 in the package 10; the embossed recesses 12 may be arranged in a desired number of rows each of a desired number of the embossed recesses 12.

Materials of the components of the package 10 and a method of manufacturing the package 10 will be described hereinafter.

The blister 11 of the package 10 must be relatively soft. Materials suitable for making the blister 11 are, for example, a relatively soft resin film, such as an unoriented polypropylene (CPP) film or a laminated film of an unoriented polypropylene (CPP) film and a polyethylene (PE) film, a thermoplastic elastomer film.

For example, a CPP film of a thickness in the range of 30 to 150 $\mu$m is preferable, and a CPP film of a thickness in the range of 60 to 120 $\mu$m is more preferable.

A CPP/PE laminated film of a CPP film of a thickness in the range of 20 to 100 $\mu$m and a PE film of a thickness in the range of 20 to 100 $\mu$m is preferable. A CPP/PE laminated film of a CPP film of a thickness in the range of 30 to 100 $\mu$m and a PE film of a thickness in the range of 20 to 80 $\mu$m is more preferable. If the thickness of each of those films is less than the lower limit of the foregoing thickness range, the embossed hollows cannot satisfactorily be formed and the strength of the same is insufficient. If the thickness of each of those films is greater than the upper limit of the foregoing thickness range, the embossed hollows are excessively hard.

The covering sheet 20 must be soft, easily tearable and moisture-proof. For example, the covering sheet 20 is a laminated sheet formed by laminating a protective film to the outer surface of an aluminum foil of a thickness in the range of 15 to 25 $\mu$m, and laminating a heat-sealing film to the inner surface of the aluminum foil.

If it is desirable that the covering sheet 20 does not have any aluminum layer in view of disposal of the covering sheet 20, the covering sheet 20 may be, for example, a uniaxial oriented polypropylene film, a uniaxial oriented polyethylene terephthalate film or a uniaxial oriented polyethylene naphthalate film. The thickness of the covering sheet 20 is, preferably, in the range of 10 to 70 $\mu$m, more preferably, in the range of 15 to 60 $\mu$m.

The covering sheet 20 may be a polypropylene film containing talc and having a thickness, preferably, in the range of 30 to 120 $\mu$m, more preferably, in the range of 50 to 90 $\mu$m.

If the covering sheet 20 is any one of the foregoing plastic films and the covering sheet 20 cannot satisfactorily bonded to the flanges 13 of the blister 11 by heat-sealing, the covering sheet 20 may be provided with an innermost layer having a heat-sealing property.

The reinforcing paper sheet 46 placed on the surfaces of the flanges 13 opposite the surface of the same to which the covering sheet 20 is bonded or on the outer surface of the covering sheet 20 opposite the surface of the same bonded to the flanges 13 is formed by processing a paper sheet. The reinforcing paper sheet 46 enhances the rigidity of portions of the package 10 corresponding to the flanges 13 to enable the covering sheet 20 to be torn easily when taking out the tablet 15 from the blister 11, and absorbs water and saliva and softens so as not to be caught in or not to injure internal organs even if a unit blister package swallowed by mistake.

Accordingly, the reinforcing paper sheet 46 may be an ordinary cardboard or paperboard capable of softening in water and having an appropriate thickness (or basis weight), because such a cardboard or paperboard has a relatively high rigidity as compared with the blister 11 and the covering sheet 20.

It is desirable that the reinforcing paper sheet is sanitary and does not contain or contains the least unavoidable amount of harmful substances to further enhance the safety of the unit blister package in case the unit blister package is swallowed by mistake. Therefore, it is preferable that the reinforcing paper sheet is made of only virgin pulp, does not contain any reused pulp, contains a natural water-soluble binder, such as starch, and does not contain any sizing agent and any fluorescent brightener. The reinforcing paper sheet need not necessarily be provided with any coating layer. Although paper sheets meeting such requirements are not available on the market, such paper sheets can easily be made by a special papermaking process.

Ivory boards for forming cartons for the direct packing of foodstuffs among paperboards available on the market meet the foregoing requirements to some acceptable extent and are satisfactory.

Water-soluble paper sheets formed by binding pulp with a water-soluble binder and dissolvable in water may be employed as the reinforcing paper sheet 46.

The reinforcing paper sheet 46 needs to have a thickness necessary to secure an appropriate rigidity. A paper sheet having a basis weight of about 100 g/m$^2$ or above is suitable for use as the reinforcing paper sheet 46. A paper sheet having a basis weight in the range of 100 to 500 g/m$^2$ is desirable as the reinforcing paper sheet 46 and a paper sheet having a basis weight in the range of 120 to 350 g/m$^2$ is preferable.

The reinforcing paper sheet 46 may be bonded to the covering sheet 20 or the flanges 13 of the blister 11 with an adhesive or the reinforcing paper sheet 46 may be coated with a thin film of the same adhesive resin as that forming the covering sheet 20 or the flanges 13 of the blister 11 by extrusion coating method and the reinforcing paper sheet 46 may be bonded to the covering sheet 20 or the flanges 13 of the blisters 11 by thermocompresion bonding.

The reinforcing paper sheet 46 has a rigidity necessary to sustain a force exerted on the blister 11 in order that the covering sheet 20 can easily be torn. The reinforcing paper sheet 46 does not injure internal organs even if the same is swallowed by mistake because the reinforcing paper sheet 46 absorbs water and softens. The reinforcing paper sheet 46 has further advantages that ① the possibility that the unit blister package is swallowed by mistake is reduced because the reinforcing paper sheet 46, differing from a transparent plastic sheet, is opaque and can be identified as paper at a glance and is not mistaken for a capsule or a wrapping wafer, and ② the edges of the package 10 provided with the reinforcing paper sheet 46 will not injure hands because the edges of the reinforcing paper sheet 46, which are not as sharp as the edges of the blister 11 which are often made of a hard polyvinyl chloride sheet and liable to injure hands when handling the package 10 in dispensaries, constitute the edges of the package 10.

A method of manufacturing the package of the present invention having the components made of the foregoing materials will be described hereinafter.

The package 10 of the present invention differs much from the conventional PTP package in that the covering sheet 20 is made of a soft material, the blister 11 is made of a soft sheet, such as a relatively soft, thin thermoplastic resin sheet, and the reinforcing paper sheet 46 is bonded to the flanges 13 to make up for the lack of rigidity of the flanges.

Therefore, basic processes for forming a plurality of embossed hollows 12 in a sheet for forming the blister 11, putting articles, such as tablets 15, in the embossed hollows 12, and bonding the covering sheet 20 to the flanges 13 of the blister 11 by heat-sealing can be accomplished by the conventional forming, packaging and sealing apparatuses only by adjusting process conditions including the forming temperature in some degree.

A soft sheet for forming the blister 11 heated by a heating apparatus of the preceding process is fed between a female die (lower die) and a male die (upper die), and the soft sheet is formed between the female die and the male die by plug assist air slip vacuum forming or simple vacuum forming to form the blister 11 having the plurality of embossed hollows 12 and having flanges 13 extending around the embossed hollows 12 (FIG. 7).

Subsequently, the blister 11 is fed by feed rollers to an article dispensing machine, and the article dispensing machine puts articles, such as tablets 15, in the embossed hollows 12 of the blister 11.

Then, the blister 11 containing the articles in the embossed hollows 12 is transported to a heat-sealing machine, and the heat-sealing machine bonds the covering sheet 20 to the flanges 13 of the blister 11 by heat-sealing so as to seal the embossed hollows 12.

The package 10 of the present invention is further provided with the reinforcing paper sheet 46 provided with the through holes 47. The reinforcing paper sheet 46 is bonded to the upper surface of the covering sheet 20 or the lower surfaces of the flanges 13 of the blister 11 so that the through holes 47 thereof coincide with the open ends 12*a* of the embossed hollows 12 of the blister 11, respectively, the tearing incisions 19*a* are formed in the flanges 13 and the covering sheet 20, and tearing incisions 19*b* are formed in the reinforcing paper sheet 46 to provide a package sheet.

Then, the package sheet is cut into packages 10 each comprising a blister 11 having a desired number of hollows, such as ten, twelve, twenty or twenty-four hollows 12 (FIGS. 19, 20, 21).

If the reinforcing paper sheet 46 is bonded to the upper surface of the covering sheet 20 (FIG. 20), the reinforcing paper sheet 46 provided with the through holes 47 may be bonded to the upper surface of the covering sheet 20, and then the covering sheet 20 may be bonded to the flanges 13 of the blister 11 by heat-sealing to seal the embossed hollows 12.

If the reinforcing paper sheet 46 is bonded to the lower surfaces of the flanges 13 of the blister 11 (FIG. 19), the embossed hollows 12 of the blister 11 may be fitted in the through holes 47 of the reinforcing paper sheet 46 so that the lower surfaces of the flanges 13 of the blister 11 are seated on the reinforcing paper sheet 46, and the reinforcing paper sheet 46 may be bonded to the flanges 13 by heat adhesion simultaneously with the bonding of the covering sheet 20 to the upper surfaces of the flanges by heat-sealing, which, however needs the modification of the conventional forming, dispensing and sealing apparatuses.

When the reinforcing paper sheet 46 is thus bonded to the flanges 13 of the blister 11, the tearing incisions 19*a* and 19*b* may be formed and the package sheet may be cut into packages 10 immediately after bonding the covering sheet 20 to the flanges 13 of the blisters 11 by heat-sealing to seal the embossed hollows 12.

When using the package 10, unit blister packages each having the blister 11, and a section of the covering sheet 20 sealing the embossed hollow 12 are separated easily by tearing the package 10 along the tearing incisions 19*a* and 19*b*.

After tearing off a unit blister package having the embossed hollow 12 from the package 10, the blister 11 having the embossed hollow 12 is crushed by the tip of a finger to press the tablet 15 against the section of the covering sheet 20, so that that the section of the covering sheet 20 is torn and the tablet 15 is taken out from the embossed hollow 12.

Although the blister 11 and the covering sheet 20 are made of soft materials, the force exerted on the blister 11 by the finger is sustained by the reinforcing paper sheet 46 bonded to the upper or the lower surface of the flange 13 of the blister, so that the section of the covering sheet can easily be torn by the tablet 15.

If the package 10 is not provided with the reinforcing paper sheet 46 and consists of only the soft blisters 11 and the soft covering sheet 20, the blister 11 and the section of the covering sheet 20 are curved and hence it is difficult to break the section of the covering sheet by crushing the blister 11 defining the embossed hollow 12 by the tip of a finger to press the tablet against the section of the covering sheet 20.

Since the edges of the reinforcing paper sheet 46 are not as sharp as the edges of a hard polyvinyl chloride resin sheet or the like, and hence there is the less danger of injuring fingers or the like by the edges of the reinforcing paper sheet 46.

It sometimes happens that the user swallows the tablet 15 together with the blister 11, the section of the covering sheet 20 and the reinforcing paper sheet 46 without taking out the same from the embossed hollow 12 defined by the blister 11.

However, although the edges of the blister 11, the section of the covering sheet 20 and the reinforcing paper sheet 46 formed by cutting the package 10 along the tearing incisions 19*a* and 19*b* are rectangular, the blister 11, the section of the covering sheet 20 and the reinforcing paper sheet 46 are not caught in or do not injure the internal organs of the user because the blister 11 and the covering sheet 20 are made of soft materials, and the reinforcing paper sheet 46 absorbs water and softens.

As is apparent from the foregoing description, the force exerted on the blister by the tip of a finger is sustained by the reinforcing paper sheet 46 bonded to the outer surface of the flange of the blister of the package even if the blister and the covering sheet are made of soft materials, so that the section of the covering sheet can easily be broken by the article, such as a tablet, contained in the blister and the article can easily be taken out of the blister. Even if the user swallows the unit blister package by mistake, the user's internal organs are not injured by the unit blister package because the unit blister package softens as the reinforcing paper sheet absorbs water and softens. Thus the package is safe and easy to use.

SIXTH EMBODIMENT

A sixth embodiment of the present invention will be described hereinafter with reference to FIGS. 22 to 24, in which parts like or corresponding to those shown in FIGS. 1 to 3 are designated by the same reference characters and the description thereof will be omitted.

Figure 22:
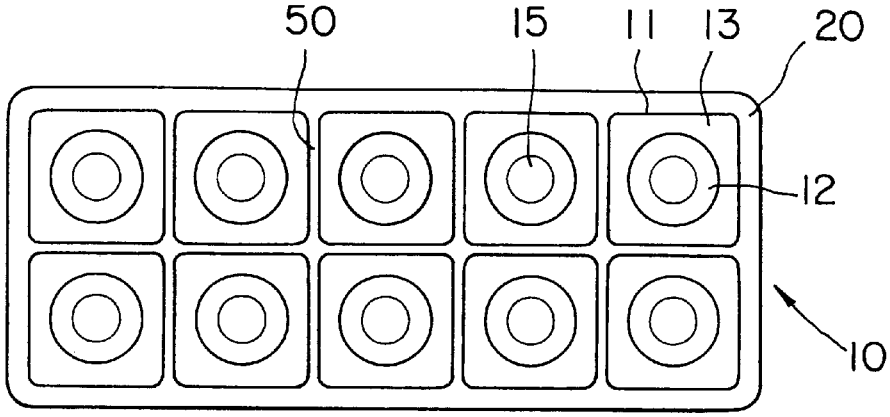
FIG. 22 is a plan view of a package in a sixth embodiment according to the present invention.
Figure 23:
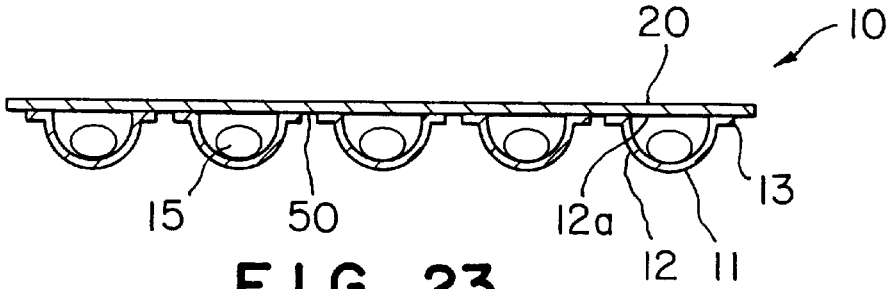
FIG. 23 is a sectional side view of the package of FIG. 22.

Referring to FIGS. 22 and 23, a package 10 comprises a plurality of blisters 11 each having an embossed hollow 12 with an open end 12*a*, for containing a tablet 15, and a flange 13 extending around the open end 12*a* of the embossed hollow 12, and a covering sheet 20 bonded to the flanges 13 of the blisters 11 by heat-sealing. In FIG. 22 showing the package 10 in a plan view, the covering sheet 20 is supposed to be transparent for convenience.

The blisters 11 are formed separately and each blister 11 has the embossed hollow 12 containing the tablet 15. The blisters 11 are disposed close to each other so as to form tearing regions 50 in the covering sheet 20 between the adjacent blisters 11.

Each blister 11 is a relatively thick sheet suitable for holding the tablet 15, such as a 200 to 350 $\mu$m thick sheet of a PVC resin, a cyclic polyolefine resin, a PP resin or a PET resin. The covering sheet 20 is a relatively thin sheet, such as a 10 to 20 $\mu$m thick laminated sheet of, for example, an OP layer, an aluminum layer and a heat-sealing layer.

As mentioned above, the blisters 11 are arranged closely for as to form the tearing regions 50 between the adjacent blisters 11, the blisters 11 are made of a relatively thick sheet and the covering sheet 20 is a relatively thin sheet. Therefore, the soft covering sheet 20 can easily be torn along the tearing regions 50 between the adjacent rigid blisters 11. Although tearing incisions need not be formed in the tearing regions 50, the covering sheet 20 may more easily be torn if tearing incisions are formed in the tearing regions 50.

Figure 24:
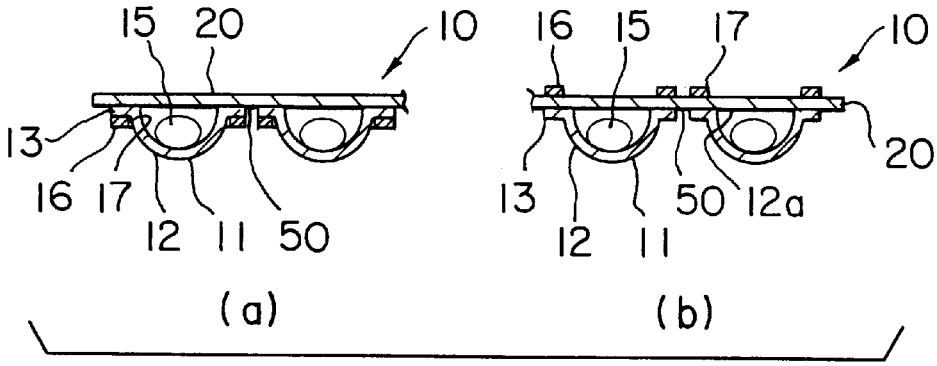
FIG. 24 is a sectional side view of a modification of the package.

Referring to FIGS. 24(*a*) and (*b*), a package 10 comprises a plurality of blisters 11 each having an embossed hollow 12 with an open end 12*a* and containing a tablet 15, and a flange 13 extending around the open end 12*a* of the embossed hollow 12, and a covering sheet 20 bonded to the flanges 13 of the blisters 11 by heat-sealing. The blisters 11 are made of a thermoplastic elastomer or a soft resin, and are relatively soft. The covering sheet 20 is a soft laminated sheet.

As shown in FIG. 24(*a*), A reinforcing ring 16 having a through hole 17 corresponding to the open end 12*a* of the embossed hollow 12 is attached to the lower surface of the flange 13 of each blister 11 so that the embossed hollow 12 is fitted in the through hole 17 of the reinforcing ring 16. As shown in FIG. 24(*b*), the reinforcing ring 16 may be attached to the upper surface of the covering sheet 20 so that the through hole 17 coincides with the open end 12*a* of the embossed hollow 12.

SEVENTH EMBODIMENT

A seventh embodiment of the present invention will be described hereinafter with reference to FIGS. 25 to 28, in which parts like or corresponding to those shown in FIGS. 1 to 3 are designated by the same reference characters and the description thereof will be omitted.

Figure 25:
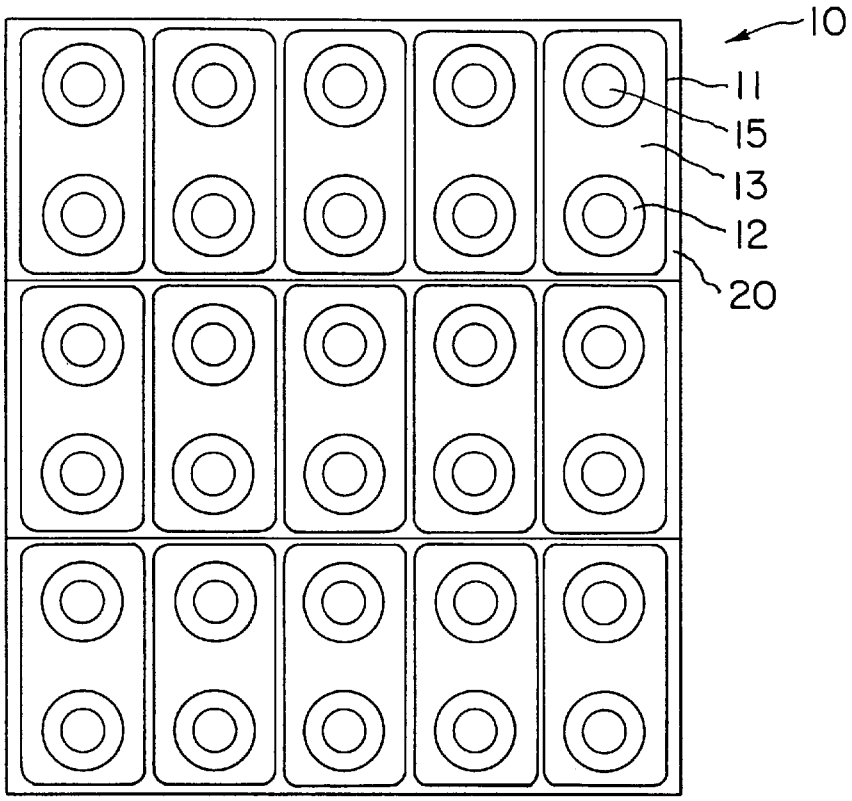
FIG. 25 is a plan view of a package in a seventh embodiment according to the present invention.
Figure 26:
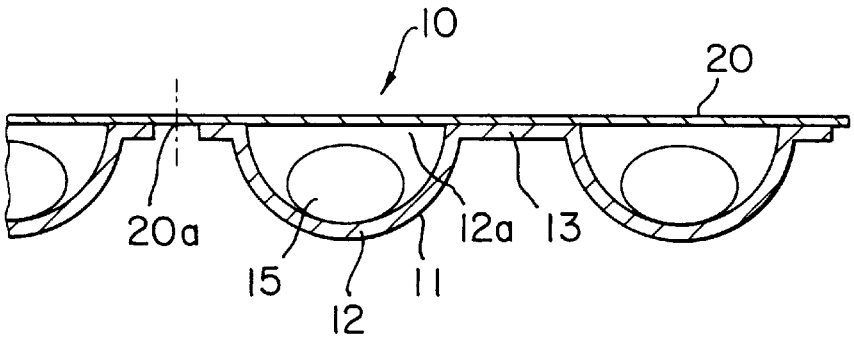
FIG. 26 is a sectional side view of the package of FIG. 25.

Referring to FIGS. 25 and 26, a package 10 comprises a plurality of blisters 11 having embossed hollows 12 with open ends 12*a*, for containing tablets 15, and flanges 13 extending around the open ends 12*a* of the embossed hollows 12, and a covering sheet 20 bonded to the flanges 13 of the blisters 11 by heat-sealing. In FIG. 25 showing the package 10 in a plan view, the covering sheet 20 is supposed to be transparent for convenience.

The blisters 11 are formed separately and each blister 11 has, for example, two embossed hollows 12 connected by the flange 13. The number of the embossed hollows 12 of each blister 11 is equal to the number of tablets for one dose.

The blister 11 is formed of a relatively thick sheet suitable for holding the tablet 15, such as a 250 to 350 $\mu$m thick sheet of a PVC resin, a cyclic polyolefine resin, a PP resin or a PET resin. The covering sheet 20 is a relatively thin sheet, such as a 20 to 30 $\mu$m thick laminated sheet of, for example, an OP layer, an aluminum layer and a heat-sealing layer.

Since the number of the embossed hollows 12 of each blister 11 is equal to the number of tablets 15 for one dose, the covering sheet 20 is torn along a tearing incisions 20*a* to separate each blister 11 from the package 10, and the tablets 15 for one dose can surely be taken out from the embossed hollows 12 of the blister 11.

A package 10 in a modification of the package 10 shown in FIGS. 25 and 26 will be described with reference to FIGS. 27 and 28. The package 10 in the modification is substantially similar to that shown in FIGS. 25 and 26, except that the package 10 shown in FIGS. 27 and 28 has blisters formed of a soft material and is provided with reinforcing rings attached to the blisters.

Figure 27:
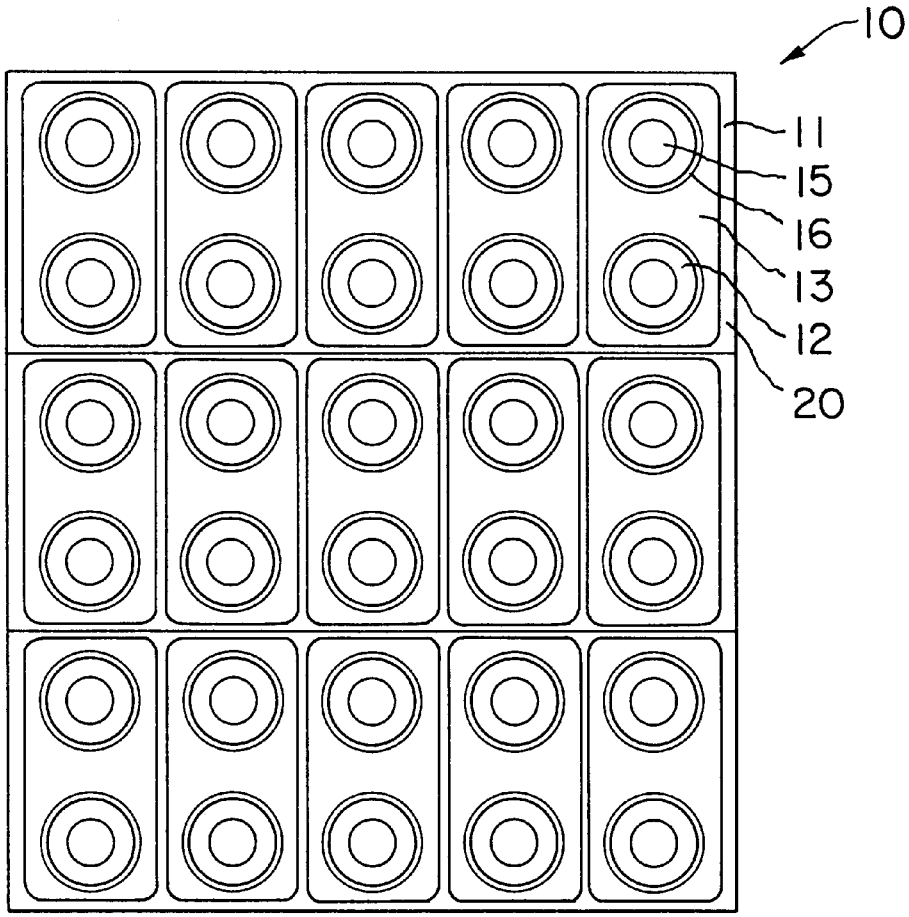
FIG. 27 is a plan view of a modification of the package.
Figure 28:
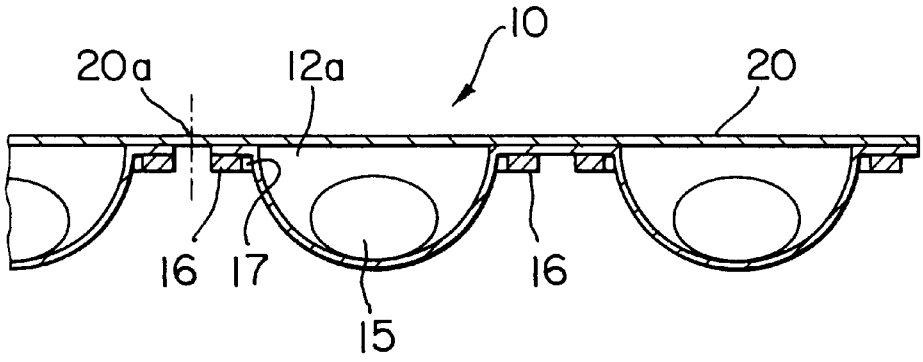
FIG. 28 is a sectional side view of the package of FIG. 27.

Referring to FIGS. 27 and 28, the package 10 has a plurality of separate blisters 11 each having two embossed hollows 12 containing tablets and a flange 13 extending around the two embossed hollows 12, and a covering sheet 20 bonded to the flanges 13 of the blisters 11 by heat-sealing.

Each blister 11 is formed of a relatively soft 100 to 200 $\mu$m thick sheet of a thermoplastic elastomer or a soft resin. The covering sheet 20 is a soft laminated sheet. As shown in FIGS. 27 and 28, hard reinforcing rings 16 having through holes 17 corresponding to the open ends 12*a* of the embossed hollows 12 are attached to the lower surface of the flange 13 of each blister 11 so that the embossed hollows 12 of the blister 11 are fitted in the through holes 17 of the reinforcing rings 16.

What is claimed is:

1. A package capable of being wound in a roll, comprising:

a soft blister having at least one embossed hollow with an open end for containing articles, and flanges extending around the open end of the embossed hollow and interconnecting the embossed hollow with a second or more embossed hollows; and a soft covering sheet bonded to the flanges;

wherein a ring having a circular shape and a through hole corresponding to the open end of the embossed hollow is mounted on one of the soft blister and the soft covering sheet at every location at which an embossed hollow appears.

2. The package according to claim 1, wherein the ring is disposed on the surface of the flange opposite to the covering sheet so that the embossed hollow is fitted in the through hole of the ring.

3. The package according to claim 1, wherein the ring is disposed on the surface of the covering sheet opposite to the flange of the blister so that the through hole thereof coincides with the open end of the embossed hollow.

4. The package according to claim 1, wherein the ring is disposed between the covering sheet and the flange so that the through hole thereof coincides with the open end of the embossed hollow.

5. The package according to claim 1, wherein the ring is made of a shape memory material which shrinks at temperatures in the range of 30 to 40° C.

6. The package according to claim 1, wherein the ring is made of a water-soluble material.

7. The package according to claim 1, wherein the ring is harder as compared with the blister and the covering sheet.

8. A package capable of being wound in a roll, comprising:

a soft blister having a plurality of embossed hollows with open ends for containing articles therein, and flanges extending around the open ends of the embossed hollows and interconnecting the embossed hollows; and a soft covering sheet bonded to the flanges;

wherein a reinforcing paper sheet provided with through holes corresponding to the open ends of the embossed hollows is attached to one of the soft blister and the soft covering sheet, and wherein a first incision is formed between the embossed hollows in said flanges and said covering sheet, and a second incision is formed in a part of said reinforcing paper sheet corresponding to said first incision.

9. The package according to claim 8, wherein the reinforcing paper sheet is disposed on the surface of the flanges opposite to the covering sheet so that the embossed hollows are fitted in the through holes of the reinforcing paper.

10. The package according to claim 8, wherein the reinforcing paper sheet is disposed on the surface of the covering sheet opposite to the flanges of the blisters so that the through holes thereof coincided with the open ends of the embossed hollows.

11. The package according to claim 8, wherein the reinforcing paper sheet is made of a paper which softens by absorbing water.

12. The package according to claim 8, wherein the reinforcing paper sheet is harder as compared with the blisters and the covering sheet.

13. A package capable of being wound in a roll, comprising:

a plurality of soft blisters each having an embossed hollow with an open end, for containing an article, and a flange extending around the open end of the embossed hollow; and a soft covering sheet bonded to the flanges of the blisters;

wherein a ring having a circular shape and a through hole corresponding to the open end of the embossed hollow is mounted on the soft blisters or on the soft covering sheet at every location at which an embossed hollow appears.

14. The package according to claim 13, wherein the ring is disposed on the surface of the flange opposite to the covering sheet so that the embossed hollow is fitted in the through hole thereof.

15. The package according to claim 13, wherein the ring is disposed on the surface of the covering sheet opposite to the flange so that the through hole thereof coincides with the open end of the embossed hollow.

16. The package according to claim 13, wherein the ring is disposed between the covering sheet and the flanges so that the through hole thereof coincides with the open end of the embossed hollow.

17. The package according to claim 13, wherein the ring is made of a shape memory material which shrinks at temperatures in the range of 30 to 40° C.

18. The package according to claim 13, wherein the ring is made of a water-soluble material.

19. The package according to claim 13, wherein the ring is harder as compared with the blisters and the covering sheet.

20. The package according to claim 13, wherein the soft blisters are arranged closely together with breaking regions therebetween in the covering sheet.

21. The package according to claim 13, wherein each of the blisters has a plurality of embossed hollows, and the embossed hollows are connected to each other by a flange.

22. A package packet comprising:

a package capable of being wound in a roll, comprising a plurality of soft blisters each having an embossed hollow with an open end, for containing an article, and a flange extending around the open end of the embossed hollow, a soft covering sheet bonded to the flanges of the blisters, and a ring having a circular shape and a through hole corresponding to the open end of the embossed hollow and mounted on the soft blister or the soft covering sheet at every location at which an embossed hollow appears; and a container containing the rolled package.

23. The package packet according to claim 22, wherein the plurality of blisters of the package are formed separately.

24. The package packet according to claim 23, wherein the ring is disposed on the surface of the flange opposite to the covering sheet so that the embossed hollow is fitted in the through holes thereof.

25. The package packet according to claim 23, wherein the ring is disposed on the surface of the covering sheet opposite to the flange so that the through hole thereof coincides with the open end of the embossed hollows.

26. The package packet according to claim 23, wherein the ring is disposed between the covering sheet and the flange so that the through holes thereof coincides with the open end of the embossed hollows.

27. The package packet according to claim 22, wherein the each of the blisters of the package has a plurality of embossed hollows, and a flange extending around the plurality of embossed hollows and interconnecting the embossed hollows.

28. The package packet according to claim 27, wherein the ring is disposed on the surface of the flanges opposite to the covering sheet so that the embossed hollow is fitted in the through hole thereof.

29. The package packet according to claim 27, wherein the ring is disposed on the surface of the covering sheet opposite to the flange so that the through hole thereof coincides with the open end of the embossed hollow.

30. The package packet according to claim 27, wherein the ring is disposed between the covering sheet and the flange so that the through hole thereof coincides with the open end of the embossed hollows.

* * * * *